US007071629B2

(12) United States Patent
Russ et al.

(10) Patent No.: US 7,071,629 B2
(45) Date of Patent: Jul. 4, 2006

(54) IMAGE DISPLAY DEVICE INCORPORATING DRIVER CIRCUITS ON ACTIVE SUBSTRATE AND OTHER METHODS TO REDUCE INTERCONNECTS

(75) Inventors: Benjamin Edward Russ, San Diego, CA (US); Jack Barger, San Diego, CA (US); Kenichi Kawasaki, San Diego, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 100 days.

(21) Appl. No.: 10/404,945

(22) Filed: Mar. 31, 2003

(65) Prior Publication Data

US 2004/0189554 A1 Sep. 30, 2004

(51) Int. Cl.
*G09G 3/10* (2006.01)
*G09G 5/00* (2006.01)

(52) U.S. Cl. ..... 315/169.3; 315/169.4; 345/206; 345/80; 313/495

(58) Field of Classification Search ..... 315/169.1, 315/169.3, 169.4; 313/495–500; 345/60, 345/55, 80, 81, 205, 206
See application file for complete search history.

(56) References Cited

U.S. PATENT DOCUMENTS 3,665,241 A 5/1972 Spindt
4,591,758 A 5/1986 Barth et al. ..... 313/528
4,857,161 A 8/1989 Borel
4,940,916 A 7/1990 Borel
5,019,003 A 5/1991 Chasen
5,053,673 A 10/1991 Tomii et al.
5,063,327 A 11/1991 Brodie
5,070,282 A 12/1991 Epsztein ..... 315/383
5,216,324 A 6/1993 Curtin
5,245,247 A 9/1993 Hosogi
5,311,360 A 5/1994 Bloom et al.
5,340,997 A 8/1994 Kuo
5,448,133 A 9/1995 Ise
5,473,222 A * 12/1995 Thoeny et al. ..... 315/169.1
5,508,584 A 4/1996 Tsai et al.
5,528,103 A 6/1996 Spindt et al.

(Continued)

OTHER PUBLICATIONS

U.S. Appl. No. 10/306,172, filed Nov. 27, 2002, Russ et al.

(Continued)

*Primary Examiner*—Wilson Lee
*Assistant Examiner*—Ephrem Alemu
(74) *Attorney, Agent, or Firm*—Thomas F. Lebens; Fitch, Even, Tabin & Flannery

(57) ABSTRACT

Flat panel displays, such as field emission displays (FEDs), plasma displays, liquid crystal displays (LCDs), and electroluminescent displays (ELs), are provided incorporating driver circuitry on the same substrate as the active display region of the display device and further reducing through-vacuum and substrate-to-substrate interconnects. In one implementation, an image display device comprises a substrate; an active display region formed on the substrate and including addressable rows and columns defining pixels; and one or more driver ICs on the substrate, respective outputs of each driver IC coupled to respective ones of the addressable rows and columns, the driver ICs adapted to drive the active display region to display an image. The device also comprises a wireless receiver coupled to the driver ICs, the wireless receiver adapted to wirelessly receive a wireless signal including an input video signal for display and couple the input video signal to the driver ICs.

31 Claims, 21 Drawing Sheets

U.S. PATENT DOCUMENTS 5,548,185 A 8/1996 Kumar et al.
5,556,316 A 9/1996 Taylor
5,561,345 A 10/1996 Kuo ..... 313/495
5,565,742 A 10/1996 Shichao
5,587,628 A 12/1996 Kuo
5,614,785 A 3/1997 Wallace
5,619,097 A 4/1997 Jones
5,649,847 A 7/1997 Haven
5,688,708 A 11/1997 Kato et al. ..... 445/25
5,689,151 A 11/1997 Wallace
5,717,287 A 2/1998 Amrine
5,773,921 A 6/1998 Keesmann et al.
5,789,848 A 8/1998 Dworsky et al. ..... 313/310
5,811,926 A 9/1998 Novich
5,827,102 A 10/1998 Watkins et al. ..... 445/24
5,834,891 A 11/1998 Novich
5,838,103 A 11/1998 Park ..... 313/495
5,880,554 A 3/1999 Liu
5,910,704 A 6/1999 Choo
5,949,394 A 9/1999 Kishino
5,962,959 A 10/1999 Iwasaki
5,977,703 A 11/1999 Ju et al. ..... 313/495
5,986,390 A 11/1999 Chuman
5,986,625 A 11/1999 Huang
6,004,912 A 12/1999 Gudeman
6,027,388 A 2/2000 Jones et al.
6,031,328 A 2/2000 Nakamoto
6,039,622 A 3/2000 Kosaka et al.
6,064,148 A 5/2000 Tolt
6,066,922 A 5/2000 Iwasaki
6,094,001 A 7/2000 Xie
6,097,138 A 8/2000 Nakamoto
6,136,621 A 10/2000 Jones et al.
6,144,144 A 11/2000 Cleeves et al.
6,146,230 A 11/2000 Kim et al.
6,149,484 A 11/2000 Amrine et al.
6,153,969 A 11/2000 Levine
6,172,456 B1 1/2001 Cathey et al. ..... 313/495
6,175,346 B1 * 1/2001 Chiu et al. ..... 345/82
6,194,333 B1 2/2001 Ryu
6,304,243 B1 * 10/2001 Kondo et al. ..... 345/100
6,323,831 B1 11/2001 Ono et al.
6,335,728 B1 * 1/2002 Kida et al. ..... 315/169.4
6,354,898 B1 3/2002 Kim
6,359,383 B1 3/2002 Chuang et al.
6,377,002 B1 4/2002 Ge et al.
6,486,597 B1 11/2002 Goel et al.
6,489,710 B1 12/2002 Okita
6,509,677 B1 1/2003 Xia et al.
6,515,429 B1 2/2003 Russ et al.
6,559,602 B1 5/2003 Russ et al.
6,582,980 B1 * 6/2003 Feldman et al. ..... 345/205
6,583,549 B1 6/2003 Takenaka
6,590,320 B1 7/2003 Abanshin et al.
6,624,590 B1 9/2003 Russ et al.
6,650,061 B1 11/2003 Urayama
6,663,454 B1 12/2003 Russ et al.
6,670,747 B1 12/2003 Ito
6,682,382 B1 1/2004 Russ et al.
6,703,643 B1 * 3/2004 Yamazaki et al. ..... 257/81
6,774,548 B1 8/2004 Fran et al. ..... 313/309
2001/0035712 A1 11/2001 Berman et al. ..... 313/495
2002/0036604 A1 * 3/2002 Yamazaki et al. ..... 345/76
2002/0047559 A1 4/2002 Frayssinet
2002/0185950 A1 12/2002 Russ et al.
2002/0185951 A1 12/2002 Russ et al.
2002/0185964 A1 12/2002 Russ et al.
2003/0052873 A1 * 3/2003 Ueda ..... 345/211
2003/0193296 A1 10/2003 Russ et al.
2003/0193297 A1 10/2003 Russ et al.
2003/0201721 A1 * 10/2003 Veillette et al. ..... 315/169.3
2004/0007988 A1 1/2004 Barger et al.
2004/0075379 A1 4/2004 Jin ..... 313/495
2004/0090163 A1 5/2004 Russ et al.
2004/0104667 A1 6/2004 Russ et al. ..... 313/495

OTHER PUBLICATIONS

U.S. Appl. No. 10/350,661, filed Jan. 24, 2003, Wang et al.
U.S. Appl. No. 10/404,712, filed Mar. 31, 2003, Russ et al.
PCT/US03/11818. Oct. 9, 2003. International Search Report. Sony Electronics, Inc.
PCT/US03/11410. Apr. 5, 2004. International Search Report. Sony Electronics, Inc.
Beer, "The Sony Trinitron Tube," *Television*. Apr. 1989. pp. 406-408. vol. 39 No. 6.
Bloom, "The Grating Light Valve: revolutionizing display technology" pp. 1-21, Oct. 1, 2002. http://www.siliconlight.com/webpdf/pw97.pdf.
Gudeman, "Diffractive Optical MEMs Using Grating Light Value Technique," *EE Times*. Mar. 18, 2002. pp. 1-4. www.eetimes.com/in_focus/communications/OEG20020315S0047.
Ito, "Carbon-Nanotube-Based Triode-Field-Emission Displays Using Gated Emitter Structure," *IEEE Electron Device Letters*, Sep. 2001. pp. 426-428. vol. 22, No. 9.
Yamada, "A New High-Resolution Trinitron Color Picture Tube for Display Application," *IEEE: Transactions on Consumer Electronics*. Aug. 1980. pp. 466-473 vol. CE-26 No. 3.
Candescent Technologies, *ThinCRT Showcase*, http://www.candescent.com/Candescent/showcase.htm, Jan 16, 2001, pp. 1-4. Candescent Technologies Corporations.
Candescent Technologies, *ThinCRT Technology*, http://www.candescent.com/Candescent/tcrttch.htm, Jan. 16, 2001, pp. 1-3. Candescent Technologies Corporation.
Candescent Technologies, *ThinCRT Concept*, http://www.candescent.com/Candescent/tcrtcnpt.htm, Jan. 16, 2001, pp. 1-6. Candescent Technologies Corporation.
Candescent Technologies, *Candescent ThinCRT Technology Primer*,, http://www.candescent.com/Candescent/techprim.htm, Jan. 16, 2001, pp. 1-5. Candescent Technologies Corporation.
PCT/US03/36758, International Search Report, Sony Corporation, Nov. 17, 2003.

* cited by examiner

IMAGE DISPLAY DEVICE INCORPORATING DRIVER CIRCUITS ON ACTIVE SUBSTRATE AND OTHER METHODS TO REDUCE INTERCONNECTS

This application is related to U.S. patent application Ser. No. 10/404,712, filed concurrently herewith, of Miyazaki, entitled "IMAGE DISPLAY DEVICE INCORPORATING DRIVER CIRCUITS ON ACTIVE SUBSTRATE TO REDUCE INTERCONNECTS", the entirety of which is incorporated herein by reference.

BACKGROUND OF THE INVENTION

1. Field of the Invention

The present invention relates generally to flat panel displays (FPDs), and more specifically to driving flat panel displays. Even more specifically, the present invention relates to driving high-resolution flat panel displays.

2. Discussion of the Related Art

Flat panel displays (FPDs), such as plasma displays and liquid crystal displays (LCDs), are becoming increasingly popular for use in display device technologies, particularly for computer monitor and television type thin displays. Furthermore, field emission displays (FEDs) are being developed for mass consumer applications.

Such flat panel displays operate by addressing many rows and columns of pixelated emitting material arranged on a thin, flat matrix. Referring to FIG. 1, in a typical vacuum-sealed FPD, such as an FED or a plasma display, the video signal is coupled to multiple driver integrated circuits (e.g., row driver IC 12 and column driver IC 14) formed on a substrate (e.g., substrates 16 and 18) having good charge carrying or mobility characteristics, such as a poly-silicon (p-Si) or a crystalline silicon (x-Si) substrate. The driver ICs are coupled to the active display region 20 which is formed on a separate substrate 22 and is vacuum-sealed within a faceplate structure in order to prevent chemical contamination, illustrated as vacuum border 24. The active display region 20 is typically formed on a glass substrate. One or more of the substrates 16, 18, 22 are fixed on a printed circuit board. Typically, the substrates 16, 18 are coupled to the substrate 22 with discrete wires 30, e.g., flexible print connectors, spanning between printed metal lines formed on the substrates. Therefore, there is a printed metal line/discrete wire/printed metal line connection coupling each output of the driver ICs 12, 14 to each row and column of the active display region 20. As is illustrated, each of the printed metal lines formed on the display substrate 22 passes through the vacuum border 24. In operation, the driver ICs 12 and 14 send the appropriate signaling to address the appropriate rows and columns of the active display region 20 to display the video signal.

Additionally, such FPDs are increasingly being used in high resolution or high definition applications. As the resolution of the device increases, the number of interconnects (i.e., discrete wires and metal lines) coupling to the active display region increases, the cost of the manufacture of the display increases and additional sources for defects are introduced. Each connection from the driver ICs to the active display region 20 controls a given column or line such that a connection defect at any point from the driver IC to the active display region 20 may result in a defective pixel. Furthermore, additional metal lines or leads passing through the vacuum seal increase the likelihood of outgassing or other compromise of the vacuum seal. Thus, it becomes increasingly difficult to reliably connect the driver ICs to the active display region 20 without compromising the display performance.

SUMMARY OF THE INVENTION

The invention provides a flat panel display device having driver integrated circuits incorporated on the same substrate having the active region and including other methods to reduce the number of wire interconnects for the device.

In one embodiment, the invention can be characterized as an image display device comprising a substrate; an active display region formed on the substrate, the active display region including a plurality of addressable rows and a plurality of addressable columns defining pixels; and one or more driver ICs on the substrate, respective outputs of each driver IC coupled to respective ones of the plurality of addressable rows and the plurality of addressable columns, the one or more driver ICs adapted to drive the active display region to display an image. The device also comprises a wireless receiver coupled to the one or more driver ICs, the wireless receiver adapted to wirelessly receive a wireless signal including an input video signal for display and couple the input video signal to the one or more driver ICs.

In another embodiment, the invention can be characterized as an image display device comprising a substrate; an active display region formed on the substrate, the active display region including a plurality of addressable rows and a plurality of addressable columns defining pixels; and one or more driver ICs on the substrate, respective outputs of each driver IC coupled to respective ones of the plurality of addressable rows and the plurality of addressable columns, the one or more driver ICs adapted to drive the active display region to display an image. The device also comprises a demodulator coupled to the one or more driver ICs, the demodulator adapted to receive a power input signal via a wireline connection to operate the one or more driver ICs. The demodulator is adapted to extract an input video signal modulated on the power signal, the input video signal to be coupled to the one or more driver ICs for display by the display device.

In a further embodiment, the invention can be characterized as a method for use in an image display device comprising the steps of: wirelessly receiving a signal inside a vacuum envelope of the image display device, the vacuum envelope sealing an active display region and one or more driver ICs on a substrate in a vacuum, the active display region including a plurality of addressable rows and a plurality of addressable columns defining pixels, wherein the signal comprises an input video signal; and coupling the input video signal to the one or more driver ICs, the one or more driver ICs adapted to drive the active display region to display an image.

In yet another embodiment, the invention can be characterized as a method for use in an image display device comprising the steps of: receiving a power signal via a wireline connection inside a vacuum envelope of the image display device, the vacuum envelope sealing an active display region and one or more driver ICs on a substrate in a vacuum, the active display region including a plurality of addressable rows and a plurality of addressable columns defining pixels; extracting an input video signal modulated on the power signal; and coupling the input video signal to the one or more driver ICs, the one or more driver ICs adapted to drive the active display region to display an image.

BRIEF DESCRIPTION OF THE DRAWINGS

The above and other aspects, features and advantages of the present invention will be more apparent from the following more particular description thereof, presented in conjunction with the following drawings.

Corresponding reference characters indicate corresponding components throughout the several views of the drawings.

DETAILED DESCRIPTION

The following description is not to be taken in a limiting sense, but is made merely for the purpose of describing the general principles of the preferred embodiments. The scope of the invention should be determined with reference to the claims.

In accordance with several embodiments of the present invention, a vacuum-sealed flat panel display device, such as a field emission display (FED) or a plasma display, is provided having driver integrated circuits (ICs) incorporated on the same substrate as the active display region of the display within the vacuum-sealed volume in order to reduce the number of interconnects for the device. Thus, advantageously, the number of wire interconnects passing through the vacuum seal, e.g., frit seal, is reduced. Furthermore, as the display resolution increases, the number of interconnects passing through the vacuum seal does not increase.

Generally, embodiments of the invention in which driver integrated circuitry is incorporated on the same substrate having the active display region in order to reduce interconnects are described with reference to FIGS. 1–13. Additional embodiments providing further methods and structure to reduce the number of wire interconnects, e.g., by wirelessly transmitting input signaling, are described with reference to FIGS. 14–25.

Figure 2:
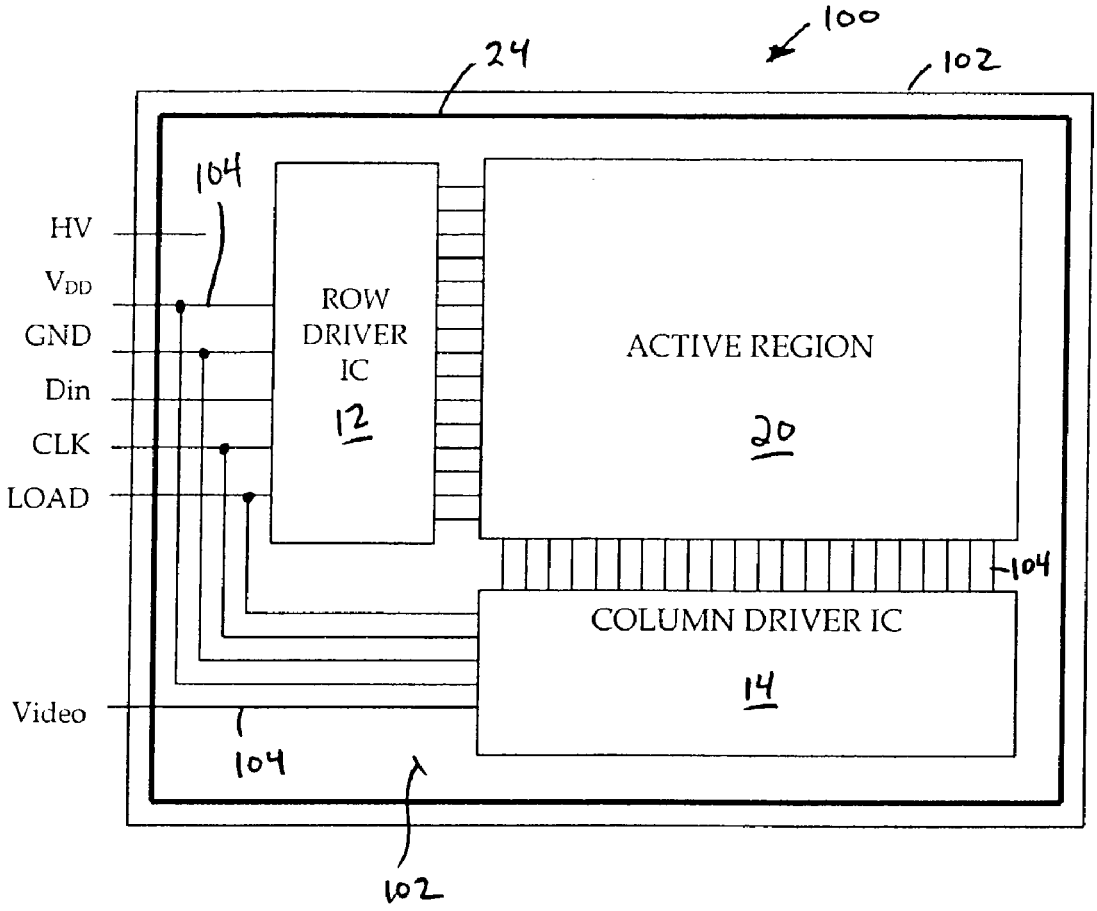
FIG. 2 is a top view schematic diagram of a vacuum-sealed display device in which driver circuitry is formed on the same substrate as the active display region and contained within the vacuum in accordance with one embodiment of the invention.

Referring first to FIG. 2, a top view schematic diagram is shown of a vacuum-sealed display device in which driver circuitry is formed on the same substrate as the active display region and contained within the vacuum in accordance with one embodiment of the invention. The image display device 100 (also referred to as a flat panel display) includes a substrate 102 having an active display region 20, a row driver integrated circuit 12 (referred to hereafter as the row driver IC 12) and a column driver integrated circuit 14 (referred to hereafter as the column driver IC 14) formed thereon. Printed metal lines 104 (also referred to as conductive leads or interconnects) are also formed on the substrate 102. The printed metal lines 104 variously couple the signal inputs to the substrate 102 to the driver ICs and couple the driver ICs 12, 14 to the active display region 20. The vacuum border 24 is defined by the boundaries of a vacuum envelope (or display structure) sealing a vacuum volume within. For example, in one embodiment, the vacuum envelope is formed by a faceplate structure sealed against the substrate 102, e.g., using frit. The volume formed within is evacuated to form the vacuum as is known in such devices.

Figure 1:
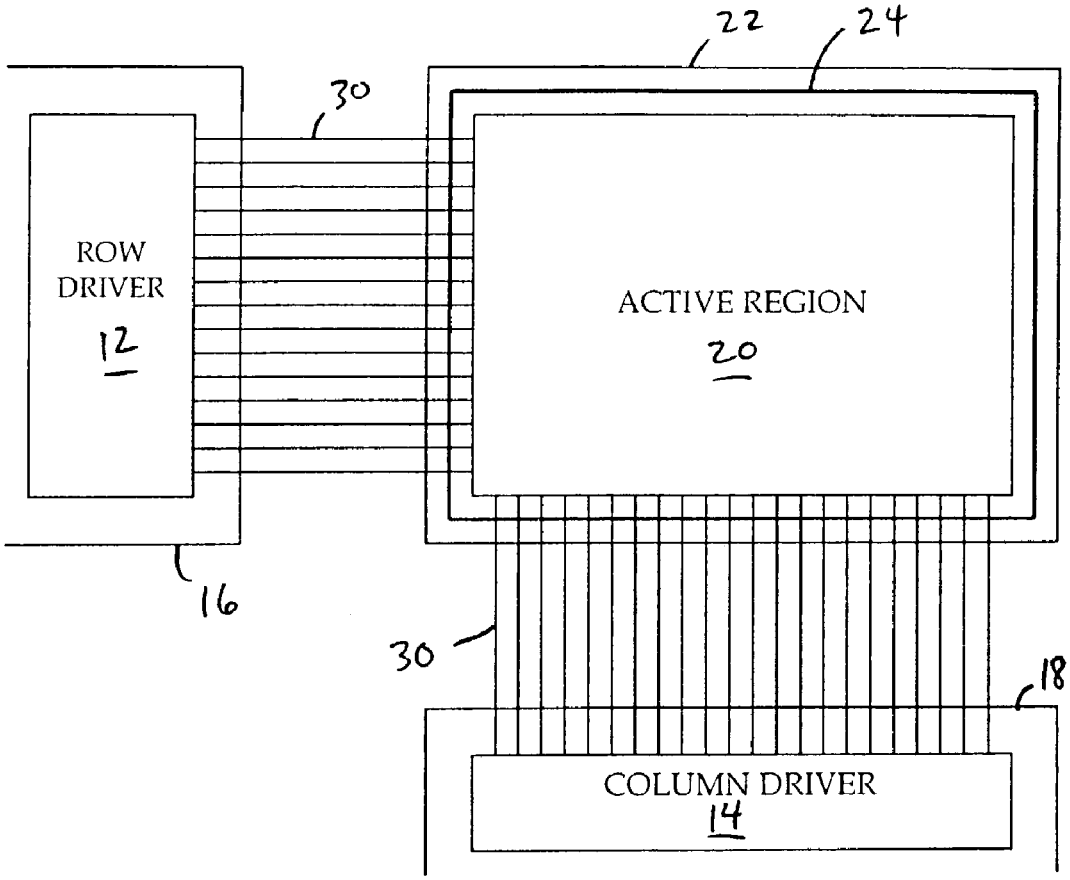
FIG. 1 (PRIOR ART)
FIG. 1 is a top view schematic diagram of a conventional vacuum-sealed display device in which the active display region is contained within a vacuum, for example, a field emission display or a plasma display, and illustrates the connections of the driver integrated circuits (driver ICs) to the active display region of the device.

As illustrated, by incorporating the driver ICs 12, 14 on the same substrate 102 as the active display region 20, the number of wire interconnects (e.g., printed metal lines) crossing through the vacuum border 24 is dramatically reduced in comparison to that illustrated in the device of FIG. 1. As described above, each printed metal line that passes through the vacuum border 24 (e.g., passes through the frit seal) introduces a point of potential leakage of the vacuum. Advantageously, according to several embodiments of the invention, as the resolution of the display 100 increases, even though the number of printed metal lines 104 that couple between the driver ICs 12, 14 and the active display region 20 must increase, the number of wire interconnects (printed metal lines) passing through the vacuum border 24 remains the same. This is particularly advantageous in high resolution or high definition display devices where the resolution may require 1000s of printed metal lines between the driver ICs 12, 14 and the active display region 20. For example, a 1024×768 high-resolution display has 1024 addressable rows and 768 addressable columns; thus, requiring at least 1792 printed metal lines to the active display region.

It is noted that although each of the driver ICs 12, 14 is illustrated as a single integrated circuit, each may comprise multiple driver ICs having a smaller number of outputs with each driver IC cascaded together to form the driver circuitry. One example is described in FIG. 5 below.

In accordance with several embodiments, the number of inputs for the substrate passing through the vacuum border 24 is to reduced to seven including: HV, $V_{DD}$, GND, Din, CLK, LOAD and VIDEO. HV is the high voltage DC to be applied to the anode of the FED or plasma display. $V_{DD}$ is a low voltage DC for operating the driver ICs 12, 14 and driving the active display region 20. GND is the ground for all devices. Din is a logic signal for the row driver IC 12 to scan to the next row or line. CLK is the clock signal to the driver ICs 12, 14 and LOAD is a latch enable signal to operate the driver ICs according to the CLK signal. VIDEO is the serial video data stream input to the driver IC 14 which is buffered and sent to the active display region 20 a line at a time for each column. These signals are coupled to the printed metal lines 104 formed on the substrate 102 using known wireline connections, such as flexible print connectors.

In comparison to traditional FEDs, the multiple metal lines from the driver ICs 12, 14 passing through the vacuum border 24 are replaced by the video input signal (VIDEO) and the various signals to operate the driver ICs. Thus, hundreds, possibly thousands of printed metal lines are reduced to a very small number, in this embodiment, seven.

In known, vacuum-sealed displays, the substrate 102 is a bulk glass substrate. In order to couple the driver ICs 12, 14 to the substrate 102, in one embodiment, discrete driver ICs, prefabricated on a p-Si and x-Si substrate are mounted (e.g., bonded or adhered) to a periphery portion of the substrate 102, the wireline connections to the driver ICs 12, 14 implemented with printed metal lines.

In an alternative embodiment, the driver ICs 12, 14 are formed on the substrate 102. However, since driver ICs should be formed on a poly-Silicon (p-Si) or crystalline-Silicon (x-Si) substrate having good mobility, a layer of silicon having poor mobility characteristics (e.g., amorphous silicon (a-Si)) is formed on the substrate 102. Since the substrate has a layer of poor mobility silicon formed thereon, the a-Si substrate is still conducive to the formation of the active display region 20. Next, a portion of the a-Si substrate 102 (e.g., the periphery portion) upon which the driver ICs 12, 14 are to be formed is laser annealed. As is well known in the art, such laser annealing turns the treated portion of the a-Si substrate into a p-Si substrate having good mobility characteristics. Thus, after annealing, the driver ICs 12, 14 may be formed on the same substrate 102 as the active display region 20. Thus, a portion of the a-Si substrate is treated to provide a substrate layer that is conducive to the formation of the driver ICs 12, 14. Accordingly, the active display region 20 is formed on the a-Si portion of the substrate 102, while the driver ICs 12, 14 are formed on the laser annealed p-Si portion of the substrate 102.

The mounting process and particularly the forming process (including the laser annealing process) introduce additional steps in the manufacturing process which in low resolution devices, introduces complexity and cost into the manufacturing process. However, as the resolution increases, the cost of the additional step becomes less than the benefit achieved and cost saved by the requiring fewer discrete wires (flexible print connectors) and the decreased likelihood of failure of a compromise of the vacuum seal. For example, in one embodiment, such additional processing becomes cost effective above VGA resolution, e.g., resolutions of 1024×768 and 1280×1024. For example, if a display device requires 2000 connections between the driver ICs 12, 14 and the active display region 20, instead of using 2000 discrete wires to connect each output of the driver ICs 12, 14 to the active display region 20 located on separate substrates 16/18 and 22, the driver ICs 12, 14 and active display region 20 are located on the same substrate 102 and lithography is used to pattern the interconnects on the substrate 102. Thus, all connections between the driver ICs 12, 14 and the active display region 20 are solid state. Furthermore, fewer printed metal lines pass through the vacuum border 24 (i.e., pass through the frit seal), which results in less opportunity to compromise the integrity of the vacuum seal.

Figure 3:
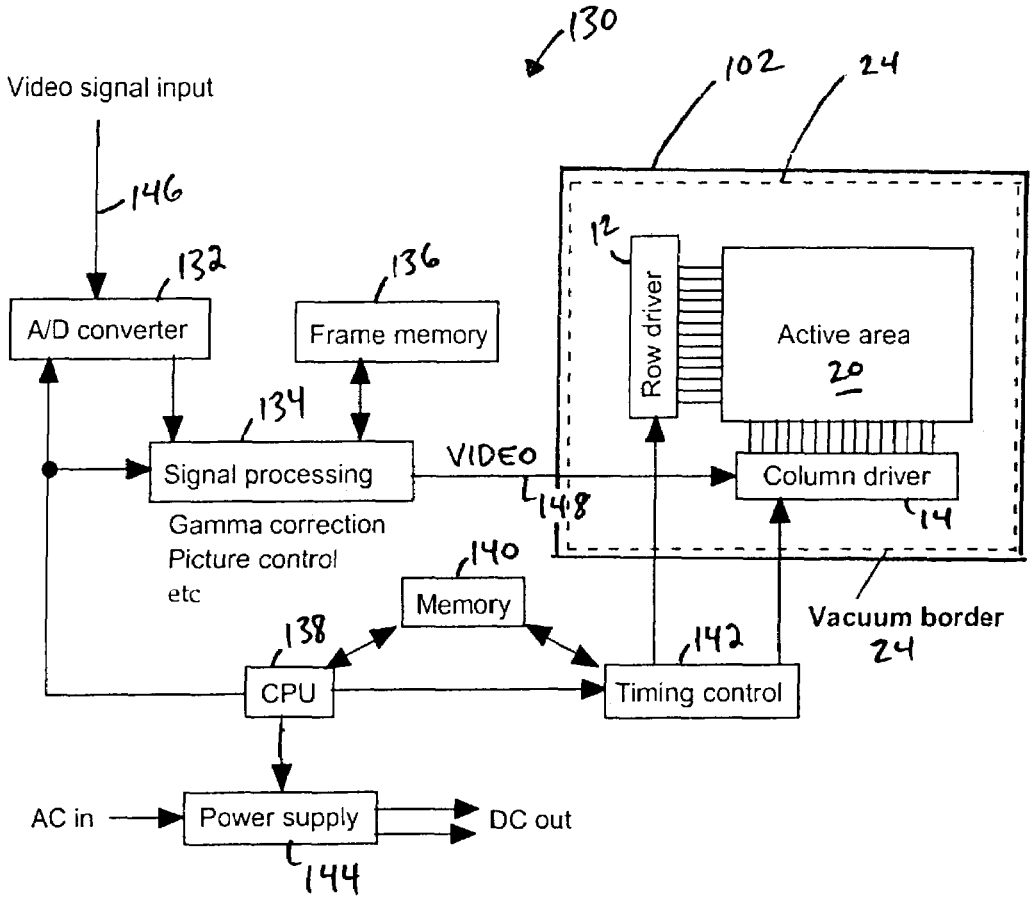
FIG. 3 is a system-level block diagram including the display device of FIG. 2 in accordance with one embodiment of the invention.

Referring next to FIG. 3, a system-level block diagram is shown including the display device of FIG. 2 in accordance with one embodiment of the invention. The system 130 includes the image display device 100, an A/D converter 132, a signal processor 134, a frame memory 136, a central processing unit 138 (hereinafter referred to as CPU 138), a memory 140, a timing control circuit 142 and a power supply 144.

In operation, an input video signal 146 to be formatted for display on the image display device 100 is digitized at the A/D converter 132, then processed (e.g., picture control and gamma correction and other known processes) by the signal processor 134. It is noted that an A/D converter 132 may not be required if the input video signal 146 is already in digital format. The frame memory 136 is used to buffer and store frames of the video signal for the signal processor 134. The output of the signal processor 134 is the video display input signal 148, i.e., the VIDEO input of FIG. 3, and is coupled to the column driver IC 14. The timing control circuit 142 provides the timing signaling, such as a clock (CLK) and other logic signals (e.g., LOAD, Din) to operate the driver ICs 12 and 14. The CPU 138 utilizes the memory 140 and controls the operation of the A/D converter 132, the signal processor 134 and the timing control circuit 142. The power supply 144 provides the high voltage (HV) to be coupled to the anode of the display device 100 and the low voltage ($V_{DD}$) to power the driver ICs 12, 14. In this example, the power supply 144 converts an input AC voltage to the appropriate DC output voltages. The individual components of the system 130 and their manufacture and operation are well known in the art. It is noted that not all connections are illustrated (e.g., the power and ground connections to the devices); however, such connections are well known in the art.

In contrast to known image display devices requiring a vacuum-sealed active display region, in accordance with several embodiments of the invention, the driver ICs 12, 14 are located on (e.g., premade and mounted on or formed on) the same substrate 102 as the active display region 20 is formed. Thus, as can be seen and as described more specifically with reference to FIG. 3, the number of wire leads crossing the vacuum border 24 is significantly reduced. That is, there are fewer physical connections passing through the frit seal. Since every printed metal line passing through the vacuum border represents a potential leakage location, with fewer connections passing through the seal, there are fewer potential leakage locations.

Figure 4:
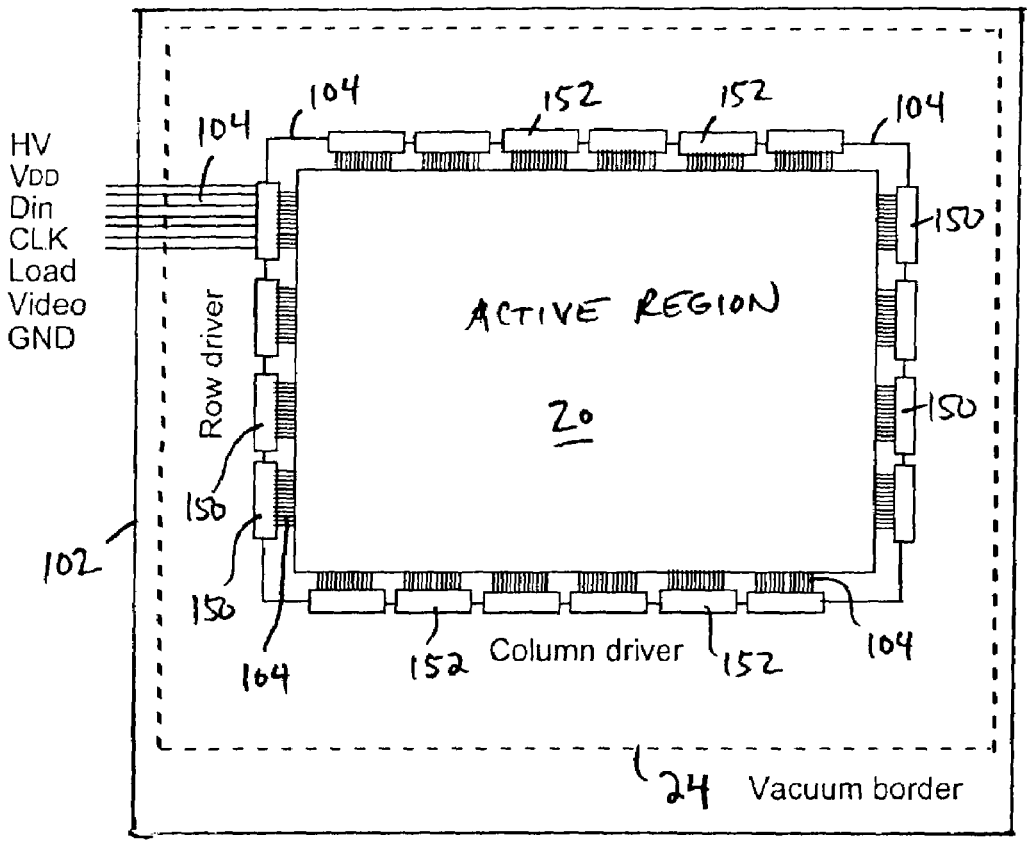
FIG. 4 is a top view schematic diagram of one embodiment of the display device of FIGS. 2 and 3 in which each of the row and column driver integrated circuits are comprised of a cascade of multiple smaller individual driver integrated circuits.

Referring next to FIG. 4, in one implementation, each of the row and column driver ICs are actually comprised of a cascade of multiple smaller individual driver ICs, e.g., row driver ICs 150 and column driver ICs 152. Each of the driver ICs 150 and 152 couple to and operate respective lines or columns of the active display region 20. Again, the number of patterned metal lines passing through the vacuum border 24 is reduced.

Figure 5:
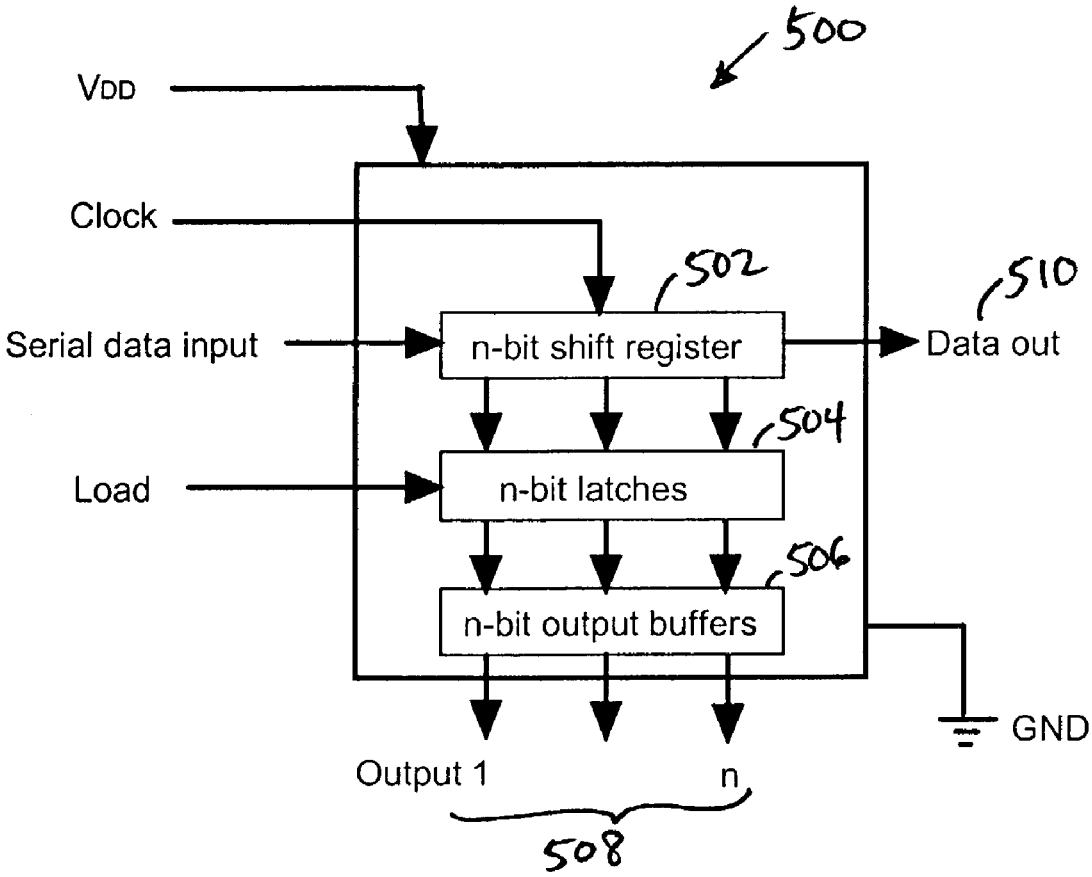
FIG. 5 is a cross sectional view of an emitting portion of an active display region and corresponding anode portion of a field emission display in accordance with one embodiment of the invention.

Referring next to FIG. 5, a functional block diagram is shown of one embodiment of a column driver IC, which may be implemented in any of the display devices described herein. The column driver IC 500 includes an n-bit shift register 502, n-bit laches 504 and n-bit output buffers 506. Inputs are $V_{DD}$ to power the driver IC 500, Clock (CLK) and Serial data input (VIDEO signal 148) to the n-bit shift register 502, and LOAD to the n-bit laches 504. In operation and as is well known in the art, the VIDEO signal is serially input to the n-bit shift registers 502. According to the timing of the CLK and upon the assertion of the LOAD signal, the serial data for each column of a portion of a given entire line is buffered into the n-bit buffers 506 and output to the active display region. Thus, the output 508 is coupled to the gate lines or columns (column drive) of the display device. The data out 510 is coupled to the next column driver IC 500 in a cascade of column driver ICs, such as illustrated in FIG. 4.

It is noted that the row driver ICs (such as implemented within row driver IC 12) are similar to the column driver ICs 500; however, the serial data input (VIDEO) is replaced by the Din signal. The Din and CLK signals operate to cause line scanning from row to row. The output 508 is an output to activate (apply a voltage) to at least a portion of a given row.

Figure 6:
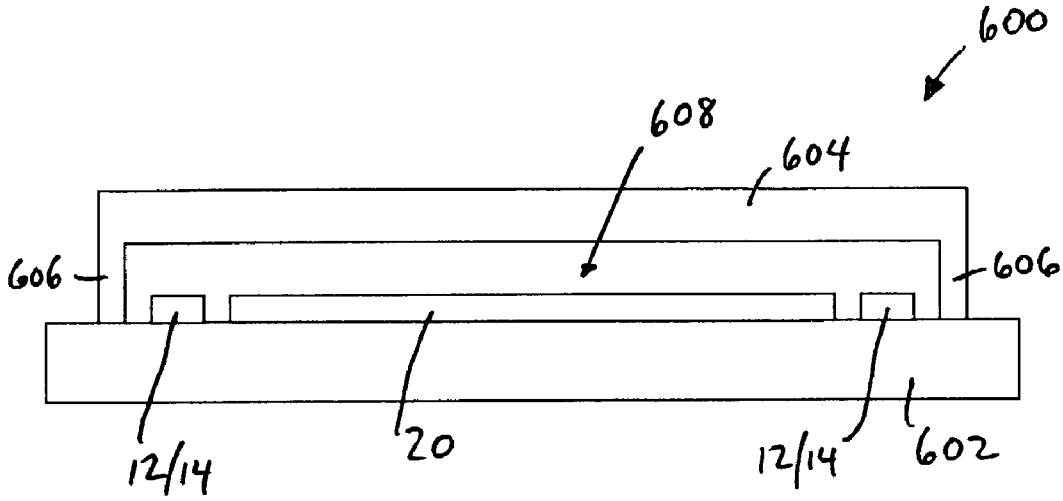
FIG. 6 is a side cutaway schematic diagram of one embodiment of the vacuum-sealed display device of FIG. 2.

Referring next to FIG. 6, a side cutaway schematic diagram is shown of one embodiment of the vacuum-sealed display device of FIG. 2. In this view, a display structure or vacuum envelope including a faceplate structure 604 and a substrate 602 contain the active components and defines the vacuum border. The substrate 602 forms a backplate of the display device 600. That is, the substrate 602 is structurally rigid, thick glass back plate including a layer of silicon (not illustrated) upon which the active display region 20 and the driver ICs 12, 14 are located. A faceplate structure 604 is illustrated having periphery edges 606 (also referred to as the skirt of the faceplate structure) that meet with the substrate 602 proximate its periphery. As is known, an anode and phosphor materials are formed on the interior surface of the faceplate structure 604. A layer of frit (not shown) seals the faceplate structure 604 to the substrate 602 at the periphery edge portion 606 to seal the vacuum within. Thus, volume 608 sealed within the substrate 602 and the faceplate structure 604 is maintained in a vacuum. The printed metal lines that pass through the vacuum border are formed on the top surface of the substrate 602. Again, the driver ICs 12, 14 are mounted or formed on the same substrate 602 as the active display region 20 and are sealed within the volume 608.

It is noted that depending on the thickness of the substrate 602 and the faceplate structure 604, spacers or other wall-like structures may be formed on the active display region 20 in order to maintain a uniform separation between the active display region 20 and the anode/phosphors of the faceplate structure 604 across the dimensions of the display device in the presence of the vacuum. However, in other embodiments, the thickness of the substrate 602 and the faceplate structure 604 may be designed such that the faceplate structure 604 and the substrate 602 support themselves across the dimensions of the display without requiring spacers or walls. For example, the thickness of the faceplate structure 604 and the substrate 602 are each sufficient to prevent deformation of the faceplate structure and the substrate across the dimensions of the faceplate structure and the substrate due to the vacuum such that spacers are not needed in order to maintain a uniform separation between the active display region on the substrate and an anode of the faceplate structure. One example of such a thick glass display device is described in U.S. patent application Ser. No. 10/306,172, filed Nov. 27, 2003, by Russ, et al., entitled "SPACER-LESS FIELD EMISSION DISPLAY", which is incorporated in its entirety herein by reference.

Figure 7:
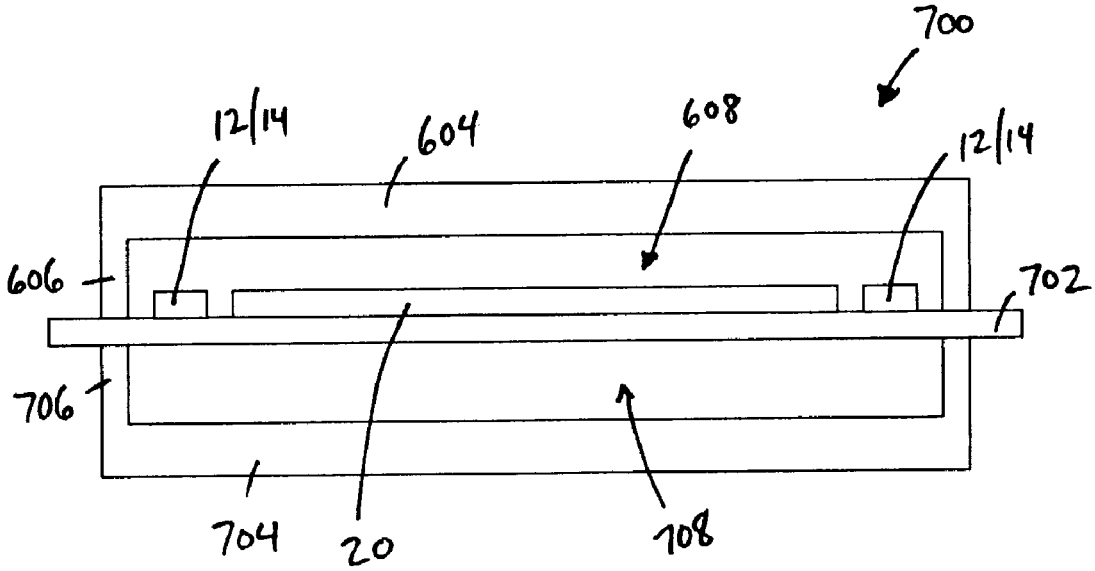
FIG. 7 is a side cutaway schematic diagram of another embodiment of the vacuum-sealed display device of FIG. 2 including a faceplate structure and a backplate structure having a thickness to support the vacuum without the use of spacers or wall structures, an additional vacuum volume is formed between a back surface of the active display region substrate and the backplate structure.

Referring next to FIG. 7, a side cutaway schematic diagram is shown of another embodiment of the vacuum-sealed display device of FIG. 2 including a faceplate structure 604 and a backplate structure 704 having a thickness to support the vacuum without the use of spacers or wall structures, an additional vacuum volume is formed between a back surface of the active display region substrate 702 and the backplate structure 704. In this embodiment of the display device 700, the substrate 702 (also referred to as the middle plate) is sandwiched between the faceplate structure 604 and the backplate structure 704. Thus, the faceplate structure 604, the backplate structure 704 and the substrate 702 form the vacuum envelope. Similar to the faceplate structure 604, the backplate structure 704 seals to a surface of the substrate 702 at its periphery portion 706, e.g., using a layer of frit (not shown). Thus, the substrate 702 sticks out of the faceplate structure 602 and the backplate structure 704, the printed metal lines passing through the frit seal on the top surface of the substrate 702.

Also noted in this embodiment, an additional volume 708 is formed between the bottom surface of the substrate 702 and the backplate structure 704. Preferably, the additional volume 708 is continuous with the volume 608. For example, there are perforations or breaks in the substrate 702 connecting the volumes 608 and 708. This allows for a larger ratio of volume to surface area of the active display region, such that the likelihood that contaminants within the volume 608/708 will stick at a portion of the active display region 20 is reduced. Furthermore, this allows getter material to be located in the volume 708 for improved gettering. Furthermore, in preferred form, the faceplate structure 604 and the backplate structure 704 have a thickness designed to withstand atmospheric pressure without requiring spacers or other wall structures to maintain uniform separation between the plates. That is, the thickness of the faceplate structure 604 and the backplate structure 704 are each sufficient to prevent deformation of the faceplate structure and the backplate structure across the dimensions of the faceplate structure and the backplate structure due to the vacuum such that spacers are not needed in order to maintain a uniform separation between the active display region and an anode of the faceplate structure. Such features and advantages are further described in U.S. patent application Ser. No. 10/306,172, as incorporated herein by reference above.

Again, since the driver ICs 12, 14 are implemented within the vacuum envelope in the devices of FIGS. 6 and 7, the number of wire interconnections passing through the vacuum envelope are significantly reduced, resulting in a greater integrity of the vacuum seal and lower manufacturing costs as resolution increases.

Figure 8:
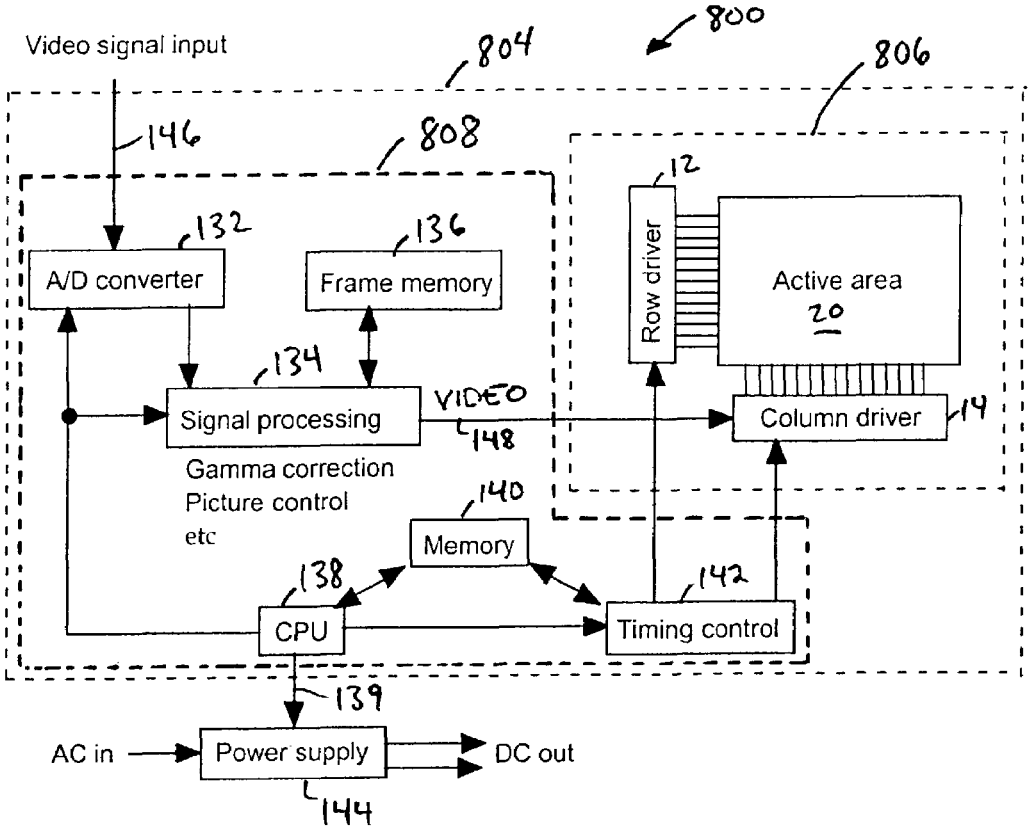
FIG. 8 is a system-level functional block diagram of a display device system in accordance with another embodiment of the invention.
Figure 9:
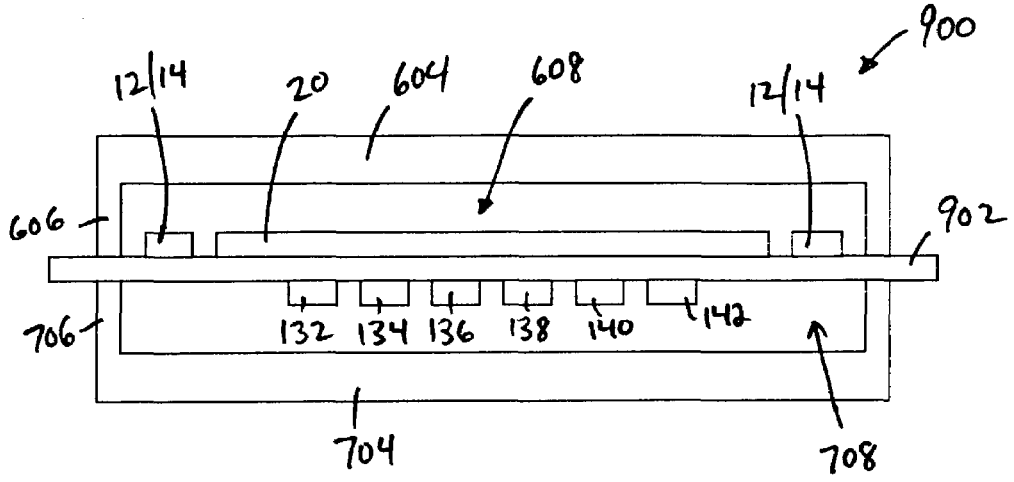
FIG. 9 is a side cutaway schematic diagram of the vacuum-sealed display device of FIG. 8 in which other control circuitry is formed on the back surface of the active display region substrate.

Referring next to FIG. 8, a system-level functional block diagram of a variation of the display device of FIG. 3 is illustrated in which other control circuitry is located (e.g., mounted or formed) on the back surface of the active display region substrate. Concurrent reference is made to FIG. 9, which illustrates a side cutaway schematic diagram the vacuum-sealed display device of FIG. 8. In this variation of the display device 700, the display device 800 includes additional circuitry on the back surface of a substrate 802. According to different embodiments, one or more of the following control circuits are located (e.g. mounted or formed) on the back surface: the A/D converter 132, the signal processor 134, the frame memory 136, the CPU 138, the memory 140 and the timing control 142. In one embodiment, one or more of the discrete driver ICs and discrete control circuits premade on a p-Si or x-Si substrate are mounted (e.g., adhered or bonded) on the top and/or bottom surfaces of the substrate 802. Similar to that described above, in an alternative embodiment, the front or top surface of substrate 802 has a layer of a-Si formed thereon and the portion of the substrate surface having the driver ICs 12, 14 has been laser annealed to a p-Si layer having good mobility characteristics. The back surface of the substrate 802 also has an a-Si layer formed thereon and has been laser annealed to form a good mobility p-Si layer. Thus, in the alternative embodiment, the additional control circuits are formed on the p-Si back surface of the substrate. Thus, rather than implementing the control circuitry on one or more separate substrates outside of the vacuum border 804, the control circuitry is mounted or formed on the back surface of the substrate 802 and is sealed within the vacuum border 804.

Dashed line 806 represents the components located (mounted or formed) on the front or top surface of the substrate 802, while the dashed line 808 represents the components located (mounted or formed) on the back surface of the substrate 802. The vacuum border 804 includes the components within dashed lines 806 and 808. In this embodiment, the number of wire leads or printed metal lines passing through the vacuum border 804 into the vacuum envelope is further reduced since the only metal lines required to pass through the vacuum border 804 are HV, the preprocessed video signal input 146, and a control signal 139 from the CPU 138 to the power supply 144.

It is noted that the printed metal lines crossing from the back surface of the substrate 802 to the front surface of the substrate (i.e., the VIDEO signal 148 and the timing control signals from the timing control 142) must couple from the back to the front surface of the substrate 802. In one embodiment, electrical conductors may be formed to pass the signaling through the substrate 802. In another embodiment, holes or apertures are formed near the periphery of the substrate 802 within the vacuum border and the leads are "wrapped around" from the back to the front surface.

Figure 10:
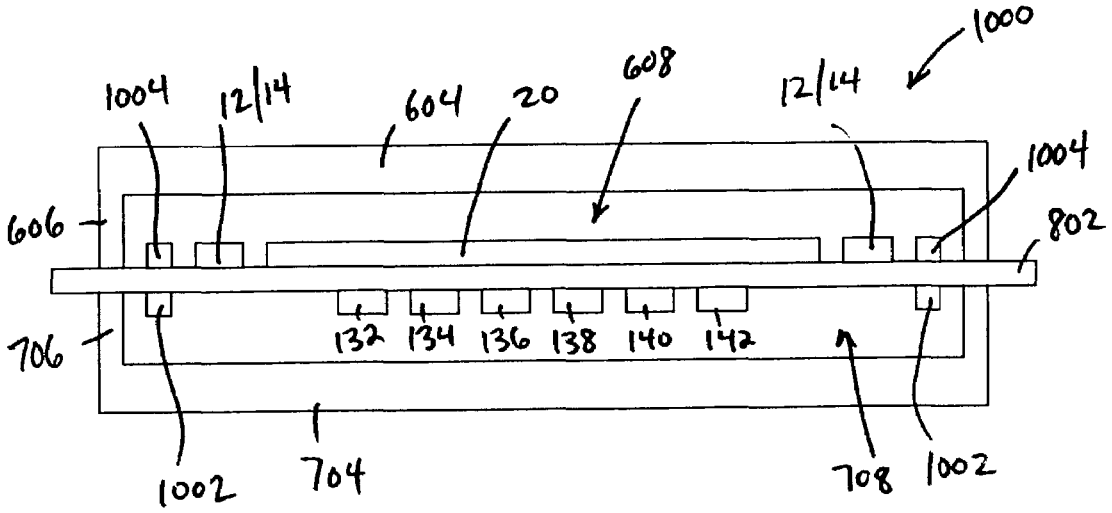
FIG. 10 is a side cutaway schematic diagram of a variation of the display device of FIG. 9 in accordance with one embodiment of the invention.

In another embodiment illustrated in FIG. 10, the signaling from the control circuitry may be wirelessly transmitted through the substrate 802. For example, one or more transmitting devices 1002 are coupled to the signal processor 134 and the timing control 142 and transmit the signaling through the substrate 802 to one or more suitable receiving devices 1004. The receiving device(s) 1004 are coupled to the driver ICs 12, 14 and wirelessly receive the signaling from the transmitting device(s) 1002. The transmitting device(s) 1002 and the receiving device(s) 1004 may be mounted or formed on the substrate similar to that described herein. Depending on the embodiment, each transmitting device 1002 may be an optical transmitter (e.g., LED, laser) or a radio frequency (RF) transmitter. Likewise, each receiving device 1004 may be a suitable optical or RF receiver. In the embodiments of FIG. 10, advantageously, wireline connections are not necessary from the back surface of the substrate 802 to the front surface of the substrate 802. However, depending on the power requirements of the transmitting device(s) 1002 and receiving device(s) 1004, additional printed metal lines providing the appropriate power may pass through the vacuum border 804.

Figure 11:
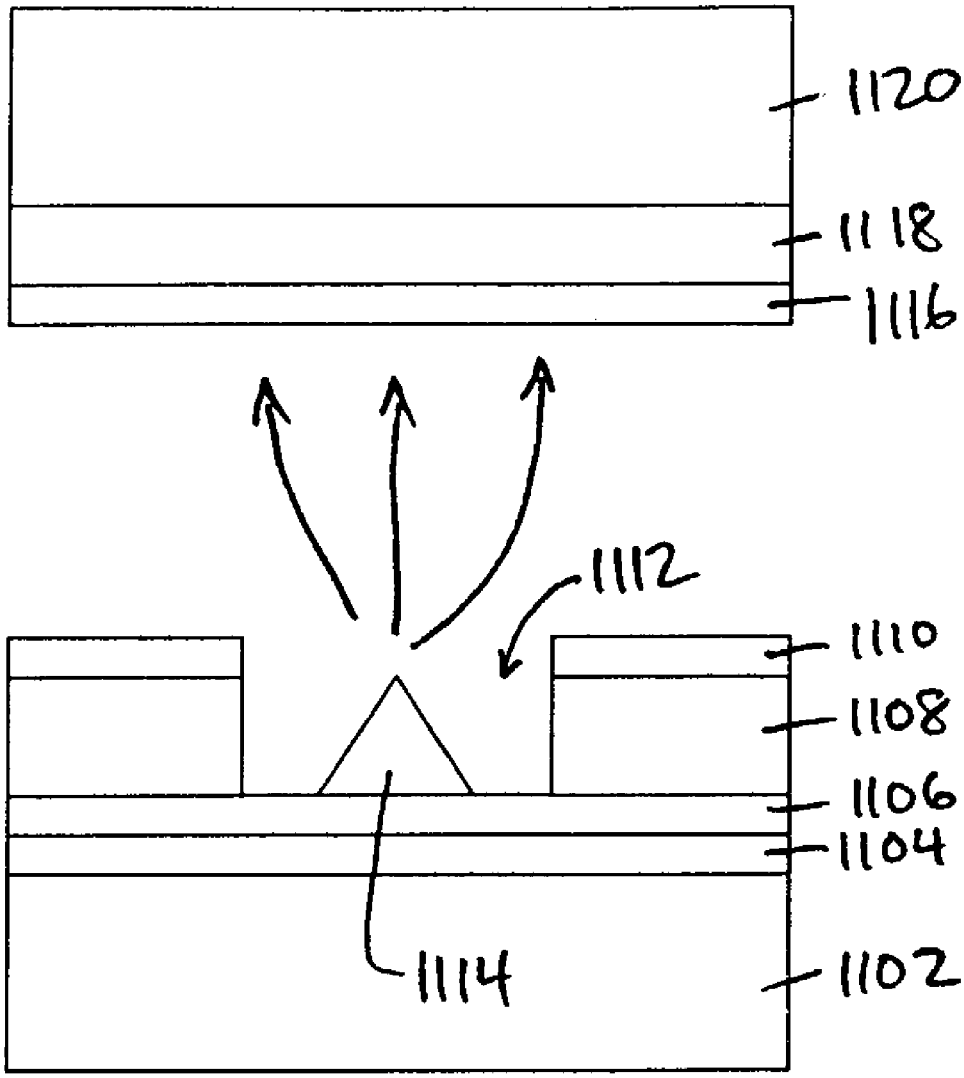
FIG. 11 is a cross sectional view of an emitting portion of an active display region and corresponding anode portion of a field emission display in accordance with one embodiment of the invention.

Referring next to FIG. 11 is a cross sectional view of an emitting portion of an active display region and corresponding anode of a field emission display. A cathode electrode 1104 is formed on a substrate 1102 (e.g., a glass substrate or as described above, a glass substrate having a layer of a-Si (not shown) formed thereon). A resistive layer 1106 is formed on the cathode electrode 1104. A dielectric layer 1108 separates the gate electrode 1110 from the cathode electrode 1104 and the resistive layer 1106. As is known, a well or aperture 1112 is formed in the gate electrode 1110 and the dielectric layer 1108 and an electron emitting material 1114 (e.g., a carbon emitter) is deposited in the aperture 1112. Upon the application of a voltage potential difference between the cathode electrode 1104 and the gate electrode 1110 by applying an appropriate drive voltage to the cathode electrode 1104 (e.g., from the row driver IC 12) and the appropriate drive voltage to the gate electrode 1110 (e.g., from the column driver IC 14), an electric field is created in the aperture 1112 which causes the release of electrons from the emitting material 1114. Additionally, the high voltage HV applied to an anode 1116 accelerates the electron emission toward phosphor 1118 material formed on the faceplate structure 1120. It is noted that each cathode electrode 1104 generally extends as a linear row across the active display region, while each gate electrode 1110 extends as a linear column across the active display region. The gate electrodes 1110 are generally perpendicular to the cathode electrodes 1104 and are electrically separated from each by the dielectric layer 1108. Each cathode electrode and each gate electrode couples to a respective output of the driver ICs 12, 14.

Although the basic structure for an FED is illustrated, it should be understood that the inventive concepts equally apply to plasma displays and other display devices in which the active display region is required to be sealed within a vacuum.

Figure 12:
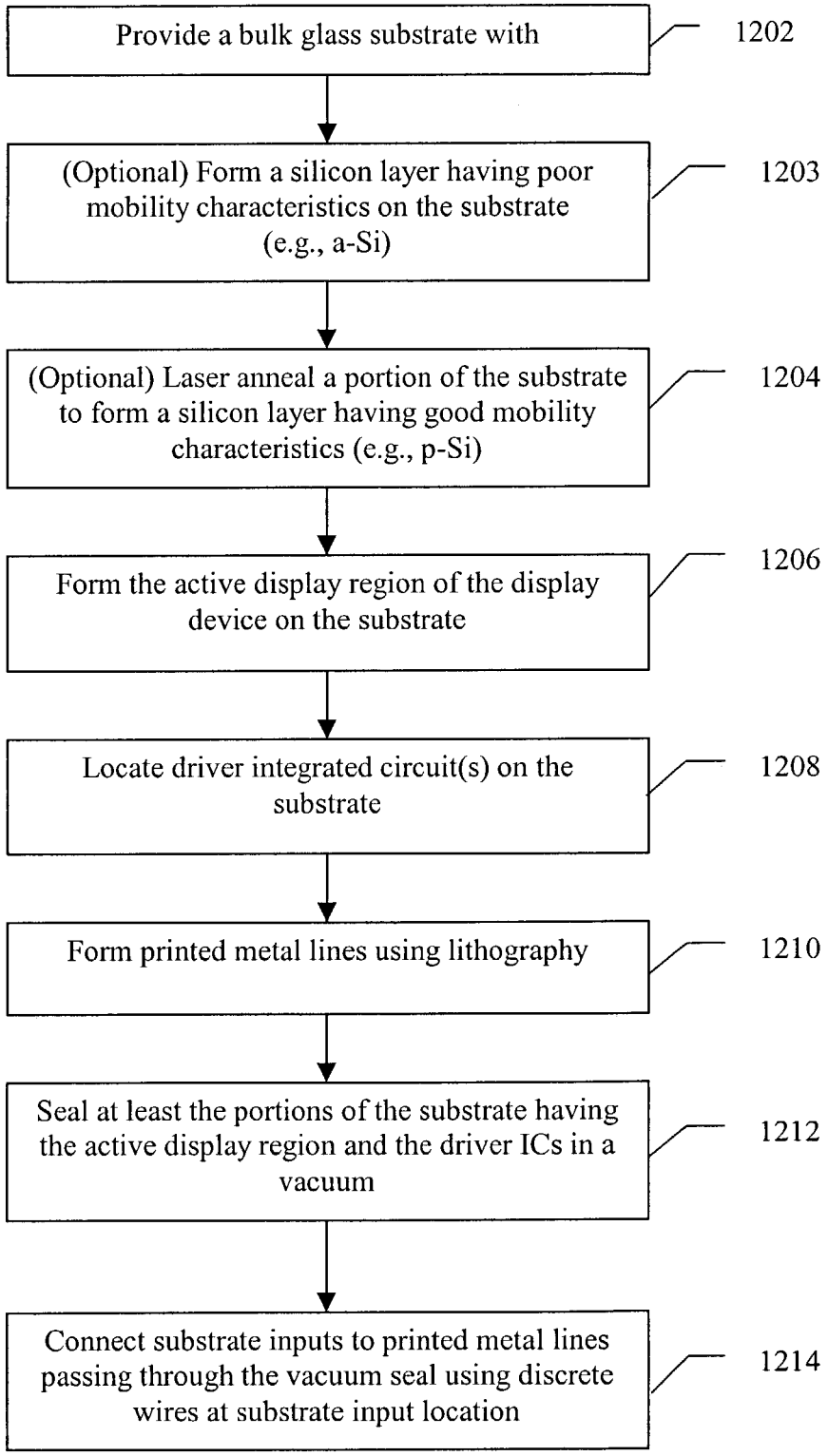
FIG. 12 is a flowchart illustrating the steps performed in manufacturing a display device in accordance with one embodiment of the invention.

Referring next to FIG. 12, a flowchart is shown illustrating the steps performed in manufacturing a vacuum-sealed display device in accordance with one embodiment of the invention. A display device in accordance with the above embodiments may be manufactured using known chip on glass semiconductor processing techniques. In one embodiment, a bulk material (e.g., glass) substrate 102 is provided (Step 1202). If, in one embodiment, discrete driver ICs are to be attached or mounted to the substrate, proceed to Step 1206. In alternative embodiments, if the driver ICs are to be formed on the substrate, a layer of silicon exhibiting poor mobility characteristics, e.g., an amorphous-Silicon (a-Si) layer, is formed on the substrate (Step 1203). Such process is well known in the art, e.g., through chemical vapor deposition. Next, a portion, preferably the periphery portion, of the a-Si substrate is transformed into a layer of silicon having good mobility characteristics, e.g., a p-Si layer, by laser annealing the a-Si substrate (Step 1204).

Whether the driver ICs are mounted or formed, the active display region 20 is then formed on the substrate (either bulk glass or a-Si) using the known semiconductor processes depending on the type of display (Step 1206). Next, the driver ICs 12, 14 are located on the substrate (Step 1208). In one embodiment, discrete and premanufactured driver ICs are mounted on the substrate. In another embodiment, the driver ICs are formed on the p-Si portion (laser annealed a-Si) of the substrate, e.g., using known semiconductor processing techniques. Solid state printed metal lines are formed on the substrate, for example, by using lithography techniques (Step 1210). The printed metal lines couple the outputs of the driver ICs 12, 14 to the rows and columns of the active display region 20 and couple the inputs of the driver ICs 12, 14 to substrate input locations for connection to discrete wires.

Next, the portions of the substrate including the active display region and the driver ICs are sealed in a vacuum environment (Step 1212), e.g., within a vacuum envelope. Such sealing is typically done by positioning a faceplate structure and against the substrate 102 with frit then completing the frit seal; thus, the faceplate structure and the substrate form the vacuum envelope. In embodiments including a backplate structure, the substrate having the active display region and the driver ICs is sandwiched between the frontplate structure and the backplate structure and sealed with frit; thus, the faceplate structure, the backplate structure and the substrate form the vacuum envelope. The sealed volume containing the active display region and the driver ICs is evacuated to create the vacuum. It is important to note that due to the fact that the driver ICs are typically formed of a ceramic material and the substrate for the active display region is typically a glass material, the vacuum sealing should be performed at less than 300 degrees Celsius in order to avoid problems with the substrate and the driver IC expanding at different rates. A typical vacuum seal is performed at about 400–450 degrees Celsius; however, such temperature may cause defects in the driver ICs. Thus, care should be taken to ensure that the vacuum sealing temperature corresponds to the temperature sensitivity of the components to be sealed therein. For example, in preferred embodiments, the vacuum sealing is performed at less than 300 degrees Celsius. Then, the substrate inputs (e.g., HV, $V_{DD}$, VIDEO, etc.) are connected to printed metal lines coupled to the inputs of the driver ICs (e.g., using flexible print connectors) at substrate input locations (Step 1214).

It is noted that there may be many individual steps to be performed in accomplishing any of the listed steps above. Furthermore, the order of steps presented in FIG. 12 is not necessarily the order in which the steps are actually performed. For example, it is understood that more than one step may be performed at the same time and the order of steps may be altered.

The exact steps in forming the active display area will vary depending on the type of display being manufactured, e.g., FED, plasma display. Specifically, in forming the active display region of an FED (Step 1206), conductive rows (cathode electrodes 1104) and driver wires (printed metal lines 104) are sputtered on the substrate out of a suitable conducting material, e.g., gold, chrome, molybdenum, platinum, etc. The cathode electrodes or rows are each coupled to the row driver IC 12. A resistive layer 1106 is then formed over the cathode lines. A layer of photosensitive dielectric 1108 or insulating material is then spin coated or formed over the substrate 102 and over portions of the cathode electrodes/resistive layer. Next, a layer of conductive gate electrode material is formed over the layer of dielectric material. Then, the gate electrode material layer and the dielectric material layer are patterned using photolithography, for example, and dry etched away to form the gate electrodes 1110 (columns) having apertures 1112. Each gate electrode or column is coupled to the column driver IC 14. The apertures 1112 are etched from the gate electrode 1110 and the insulating layer 1108 and expose the underlying resistive layer 1106. Next, the emitter material 1114 is deposited in each aperture 1112.

Figure 13:
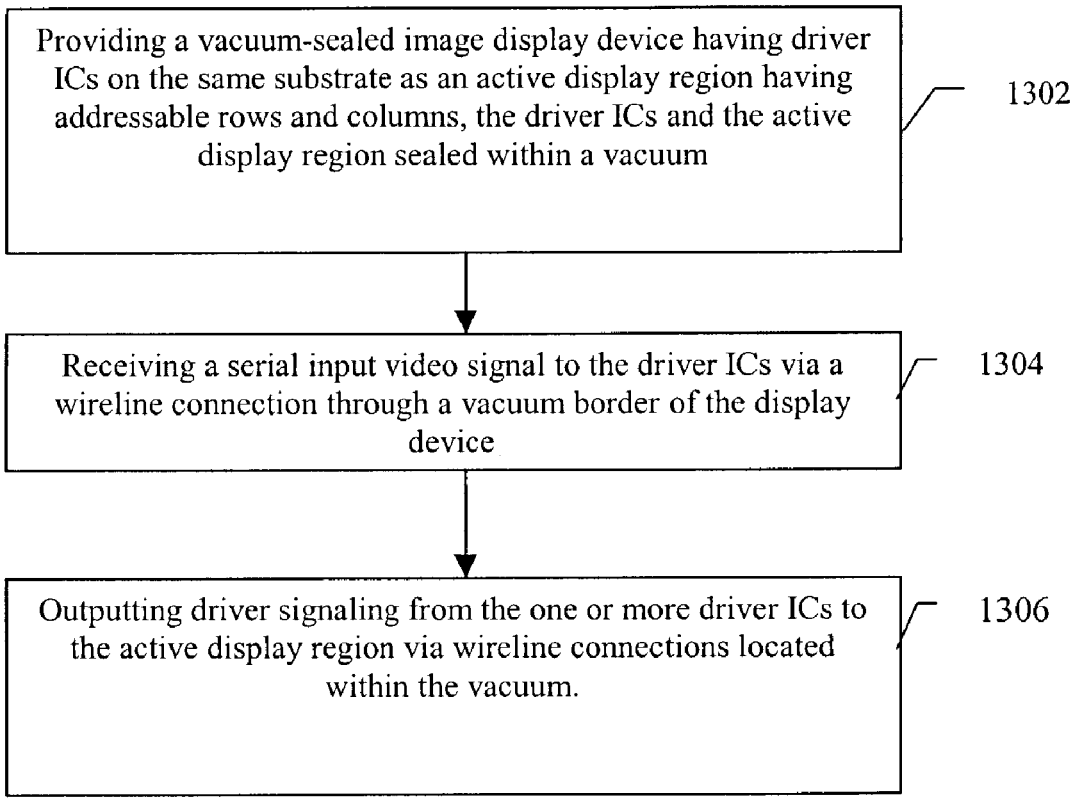
FIG. 13 is a flowchart illustrating the steps performed in the operation of a vacuum-sealed display device in accordance with one embodiment of the invention.

Referring next to FIG. 13, a flowchart is shown illustrating the steps performed in the operation of a vacuum-sealed display device in accordance with one embodiment of the invention. Initially, a vacuum-sealed image display device having driver ICs on the same substrate as an active display region is provided (Step 1302). The active display region includes addressable rows and columns, the driver ICs and the active display region sealed within a vacuum envelope. The driver ICs may be mounted or formed on the substrate. For example, an image display device, such as illustrated in FIGS. 2–10 may be provided. Next, a serial input video signal is received at the driver ICs via a wireline connection through a vacuum border of the display device (Step 1304). The vacuum border is defined by a vacuum envelope sealing the portion of the substrate having the driver ICs and the active display region therein. In preferred embodiments, the input video signal is received over a printed metal line passing through the vacuum border. Next, driver signaling is output from the driver ICs to the active display region via wireline connections located within the vacuum (Step 1306). Thus, the wireline connections (e.g., printed metal lines) from the driver ICs to the active display region are entirely contained within the vacuum envelope and do not pass through a vacuum border. Advantageously, the single input video signal wireline passing through the vacuum border replaces a number of wireline connections passing through the vacuum border depending on the resolution of the device, such as illustrated in FIG. 1. It is noted that these steps may be modified or added to depending on the embodiment. For example, in embodiments incorporating control circuitry within the vacuum envelope, the input video signal may be processed (e.g., by a signal processor) prior to being coupled to the driver ICs.

The following portion of the specification describes further embodiments providing additional techniques to further reduce the number of wire interconnects to the display device.

Figure 14:
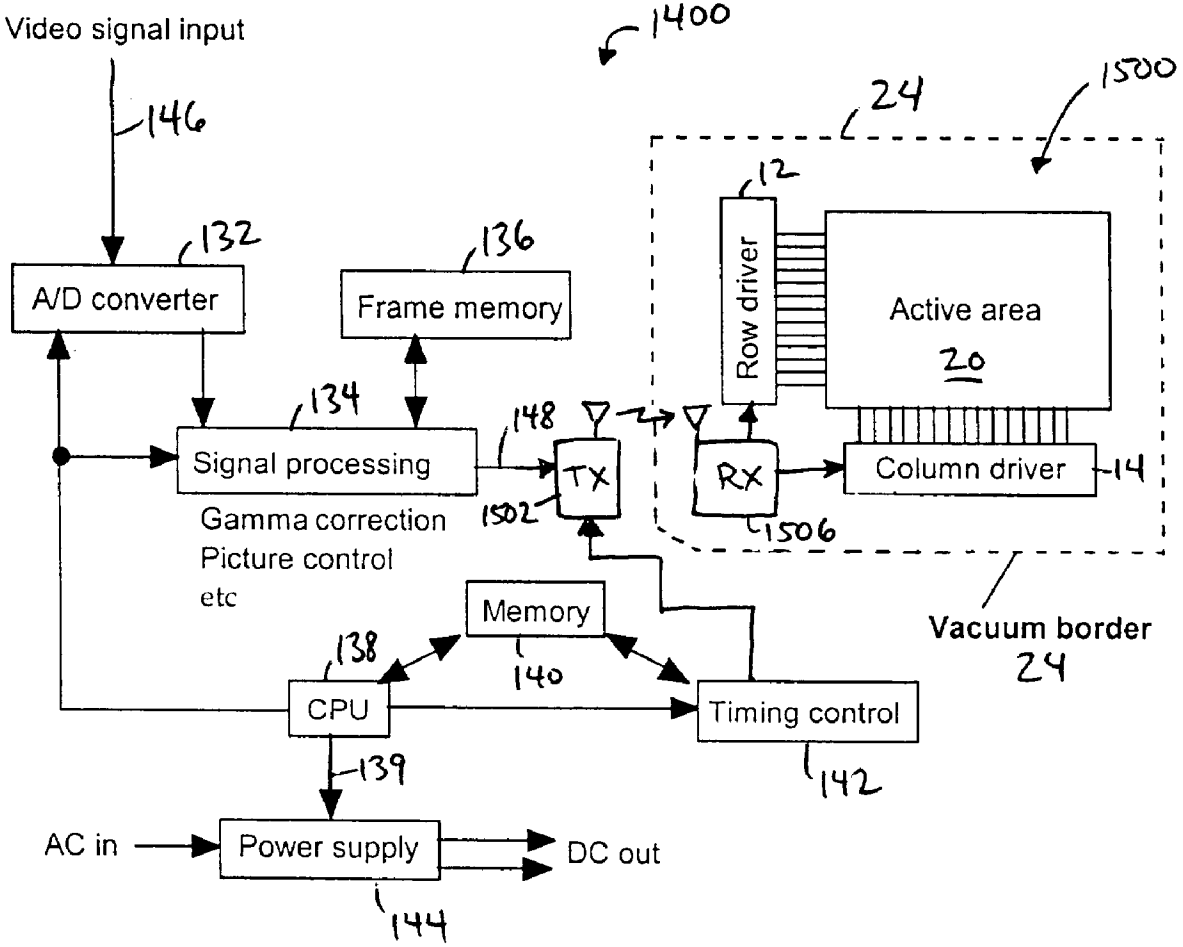
FIG. 14 is a system-level block diagram of a display device system in accordance with one embodiment of the invention.
Figure 15:
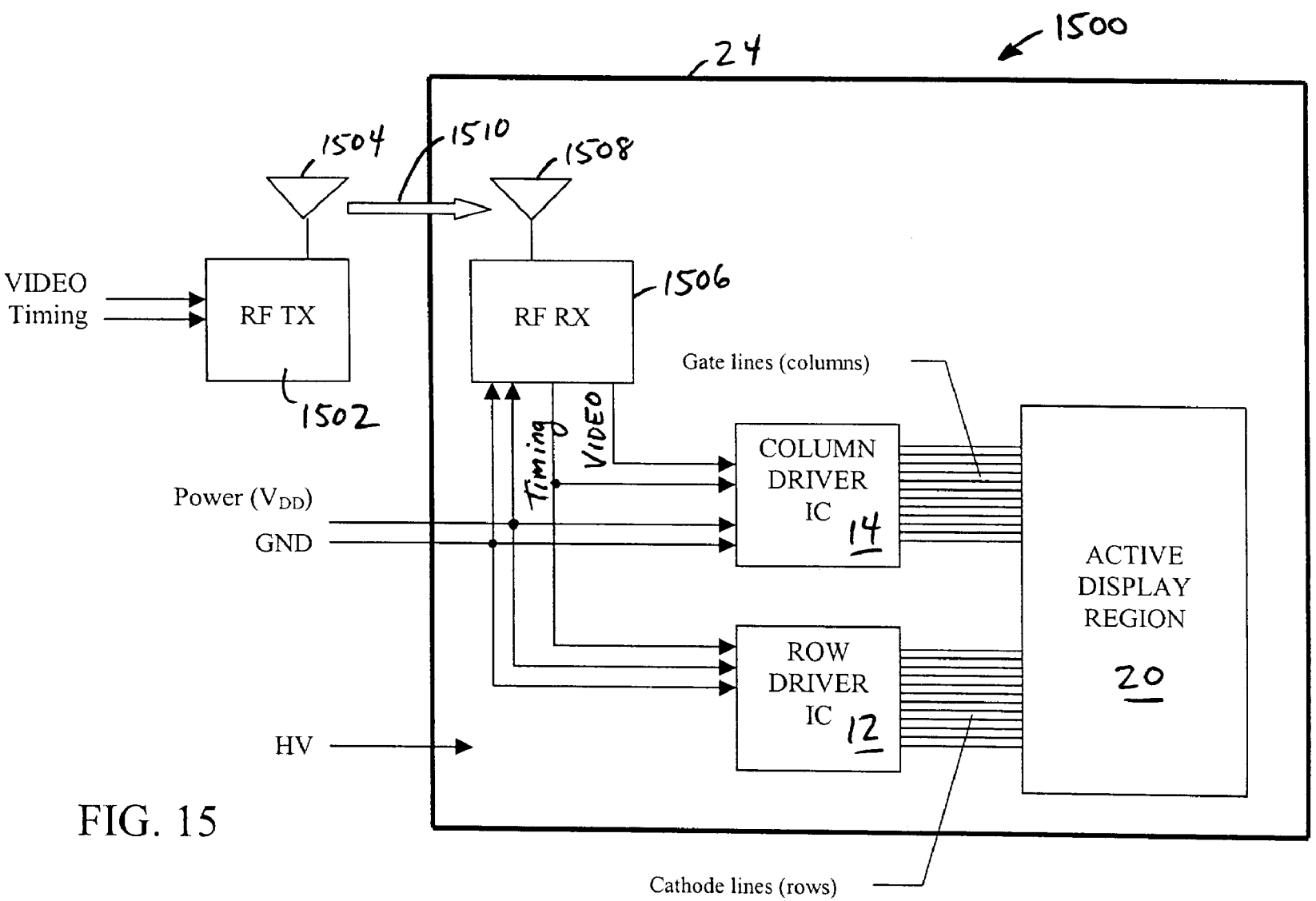
FIG. 15 is a functional block diagram of a vacuum-sealed display device of the system of FIG. 14 including driver circuitry on the same substrate as the active display region and is within the vacuum, which further reduces the number of wire leads that must pass through a vacuum seal by wirelessly transmitting video and timing signals through the vacuum seal to the driver circuitry in accordance with another embodiment of the invention.

Referring first to FIG. 15, a functional block diagram is shown of a vacuum-sealed display device 1500 including driver circuitry on the same substrate as the active display region 20 and within a vacuum envelope, which further reduces the number of wire leads that must pass through a vacuum seal by wirelessly transmitting video and timing signals through the vacuum seal to the driver circuitry in accordance with another embodiment of the invention. While referring to FIG. 15, concurrent reference will be made to FIG. 14, which illustrates a system-level schematic diagram of a system 1400 including the vacuum-sealed display device of FIG. 15.

As described above, the display device 1500 includes the row driver IC 12 and the column driver IC 14, the outputs of each coupled to the respective rows and columns of the active display region 20 (e.g., via printed metal lines as described above). As described above, the driver ICs 12, 14 may be discrete ICs that are mounted on the substrate containing the active display region 20 or are formed on the same substrate using chip on glass technology. A vacuum envelope or display structure (e.g., including a faceplate structure and a backplate structure) is configured to seal a volume containing the driver ICs 12, 14 and the active display region 20 within a vacuum, the boundaries of the vacuum envelope illustrated as vacuum border 24. As described above, the number of wireline connections passing through the vacuum seal (e.g., frit seal) is dramatically reduced by locating the driver ICs 12, 14 on the same substrate as the active display region 20.

In this embodiment, as illustrated in FIGS. 14 and 15, in order to further reduce the number of wireline connections (e.g., printed metal lines) passing through the vacuum border 24, the input video signal (VIDEO) and timing signals (e.g., CLK, Din and LOAD) are wirelessly transmitted through the vacuum border 24 to the driver ICs. Thus, the only wireline connections passing through the vacuum border 24 are the low voltage power ($V_{DD}$) to operate the driver ICs, the high voltage (HV) for the anode and the ground signal (GND). It is noted that the power wireline connections are not illustrated in FIG. 14. Again, as described above, the connections from the driver ICs 12, 14 to the active display region 20 are all contained within the vacuum border.

Accordingly, the input video signal and the timing signaling are coupled to a radio frequency transmitter 1502 (hereinafter referred to as the RF transmitter 1502 and generically referred to as a wireless transmitter) located outside of the vacuum border and having a transmit antenna 1504 (hereinafter referred to as the TX antenna 1504). The RF transmitter 1502 modulates the input video signal and the timing signaling on an RF carrier and transmits the signaling via the TX antenna 1504. Preferably, the RF transmitter 1502 is a high bandwidth, low power device capable of transmitting a high bandwidth wireless signal 1510. The wireless signal 1610 is received on the throughside of the vacuum border 24 (i.e., within the vacuum envelope) by an RF antenna 1608 coupled to an RF receiver 1506 (generically referred to as a wireless receiver). The RF receiver 1506 couples the input video signal to the column driver IC 14 and couples the timing signaling to both driver ICs 12, 14.

Thus, advantageously, the input video signal and the timing signals are wirelessly passed into the vacuum envelope, reducing the number of wireline connections passing through the vacuum border 24. As described above, each wireline connection passing through the vacuum border 24, whether a printed metal line or other discrete wire, represents a potential source of leakage for the vacuum. Therefore, reducing the number of wireline connections passing through the vacuum border 24 improves the lifetime performance of the display device.

It is noted that generically, the input video signal and the timing signals are wirelessly transmitted into the vacuum envelope. In one embodiment, the wireless transmission is accomplished using RF wireless signaling, e.g., using the RF transmitter 1502 and the RF receiver 1506 as illustrated in FIGS. 14 and 15. However, it is understood that in alternative embodiments, the wireless transmission may be accomplished using optical wireless transmission. In this embodiment, the transmitter/receiver pair comprise an optical wireless transmitter and an optical wireless receiver, as known in the art. It is further noted that the portion of the vacuum envelope through which the wireless transmission is to occur should be generally transmissive to at least the wavelength(s) of transmission.

Depending on the embodiment, the RF receiver 1506 and RX antenna 1508 may be variously located within the volume defined by the vacuum border 24. In one embodiment, the RF receiver 1506 is mounted or formed on the same substrate as the driver ICs 12, 14 and the active display region 20, preferably at a periphery edge of the substrate near the vacuum border. The RF receiver 1506 then couples the input video signal and the timing signaling to the driver ICs via printed metal lines (solid state connections). The RX antenna 1508 may be integrated on the substrate or be coupled to the RF receiver on the substrate, e.g., a simple wire antenna. In one variation in which the vacuum envelope is formed by a faceplate structure and a backplate structure sandwiching the substrate, the RF receiver 1506 is located or formed on a back surface of the substrate. In another embodiment, the RF receiver is formed or located on an interior surface of the vacuum envelope forming the vacuum border 24. For example, the RF receiver 1506 is coupled to the back surface of the backplate structure. In embodiments where the RF receiver 1506 is not mounted or formed on the substrate, the RF receiver is coupled via discrete wireline (e.g., the flexible print connectors) to printed metal lines of the substrate, the printed metal lines coupled to the driver ICs 12, 14.

The RF transmitter 1502 and TX antenna 1504 may be variously located. For example, in one embodiment, the RF transmitter 1502 is mounted or formed on a portion of the substrate extending outside of the vacuum envelope. In another embodiment, the RF transmitter 1502 is mounted or formed on a separate substrate located near the vacuum border. In another embodiment, the RF transmitter 1502 may be coupled to or mounted on an exterior portion of the display structure forming the vacuum envelope. The TX antenna 1504 may be integrated with the RF transmitter 1502 or may be coupled to the RF transmitter 1502, e.g., a simple wire antenna. It is noted that if the RF receiver 1506 is located on the substrate, it may be mounted or formed on the substrate as described above.

It is preferred that the RF transmitter/TX antenna be located as close as possible to the RF receiver/RX antenna in order to minimize the power requirements and ensure as little interference from other RF sources as possible and little interference with other components of the display device. However, close proximity is not required in all embodiments. For example, the RF transmitter 1502 and TX antenna 1504 may be remotely located relative to the display device; however, in such embodiments, the transmit power, encoding, modulation, etc. of the signaling from the RF transmitter 1502 will have to account for the distance between the RF transmitter 1502 and the RF receiver 1506, security, multipath reflections and interference.

In the system view of FIG. 14, the input video signal 148 is received at the RF transmitter 1502 from the signal processor 134, which processes the input video signal 146 having been digitized. The timing signals (e.g., CLK, Din and LOAD) are received from the timing control circuit 142. These signals are coupled to the RF transmitter 1502 via wireline connections, such as printed metal lines, flexible print connectors, or other wireline connections depending on the location of the RF transmitter 1502. For example, the RF transmitter 1502 may or may not be located on the same substrate as the other control circuitry. It is noted that many of the components of the system 1400 are functionally the same as the components earlier described.

Figure 16:
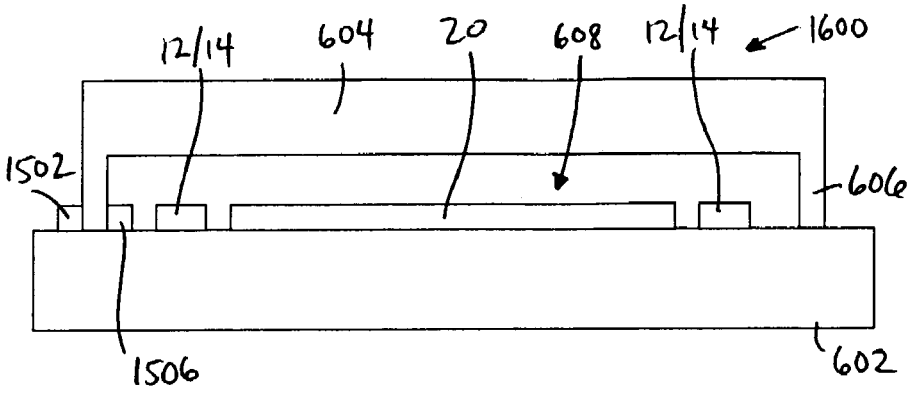
FIG. 16 is a side cutaway schematic diagram of one embodiment of the vacuum-sealed display device of FIG. 15.

Referring next to FIG. 16, a side cutaway schematic diagram is shown of one embodiment of the vacuum-sealed display device of FIG. 15. It is noted that many of the components of the display device 1600 have been previously described. In this embodiment, a vacuum envelope defining the vacuum border 24 is formed by the faceplate structure 604 and the substrate 602 sealed together, e.g., by frit. The driver ICs 12, 14 are located on the substrate 602 including the active display region 20. In this embodiment, the RF transmitter 1502 is mounted or formed on a portion of the substrate 602 extending outside of the vacuum border, while the RF receiver 1506 is mounted or formed on a surface of the substrate 602 just within the vacuum envelope. Advantageously, the RF transmitter 1502 and RF receiver 1506 are located in close proximity to provide low power requirements and less interference.

Figure 17:
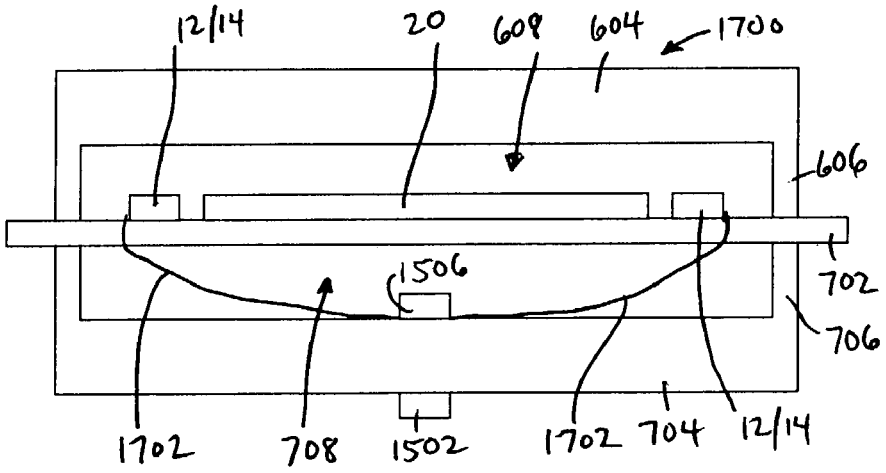
FIG. 17 is a side cutaway schematic diagram of another embodiment of the vacuum-sealed display device of FIG. 15 including a display structure having a faceplate structure and a backplate structure forming the vacuum in accordance with an embodiment of the invention, a receiving device located against the backplate structure.

Referring next to FIG. 17, a side cutaway schematic diagram is shown of another embodiment of the vacuum-sealed display device of FIG. 15 including a vacuum envelope formed by a faceplate structure 604, a backplate structure 704 and a substrate 702 sandwiched therebetween. In this embodiment, the RF receiver 1506 is located on an interior surface of the backplate structure 704, the RF transmitter 1502 located on a corresponding exterior surface of the backplate structure 704. Again, the RF transmitter and RF receiver are located in close proximity to each other to minimize power and interference. Furthermore, in this embodiment, the RF receiver 1506 is located in the additional volume 708 formed between the backplate structure 704 and the back surface of the substrate 702. As described above, the additional volume 708 is continuous with the volume 608 (i.e., there are breaks or perforations in the substrate 702 about its periphery within the vacuum border), such that the vacuum includes both volumes 608 and 708. Advantageously, in this embodiment, the RF receiver 1506 does not take up additional substrate surface area on the front or top surface of the substrate 702, so that the active display region may take up as much of the area of the top surface of the substrate 702 as possible. The signaling received at the RF receiver 1506 is preferably coupled to the driver ICs 12, 14 via a wireline connection 1702 (e.g., a flexible print connector) coupled to the respective driver ICs 12, 14.

Figure 18:
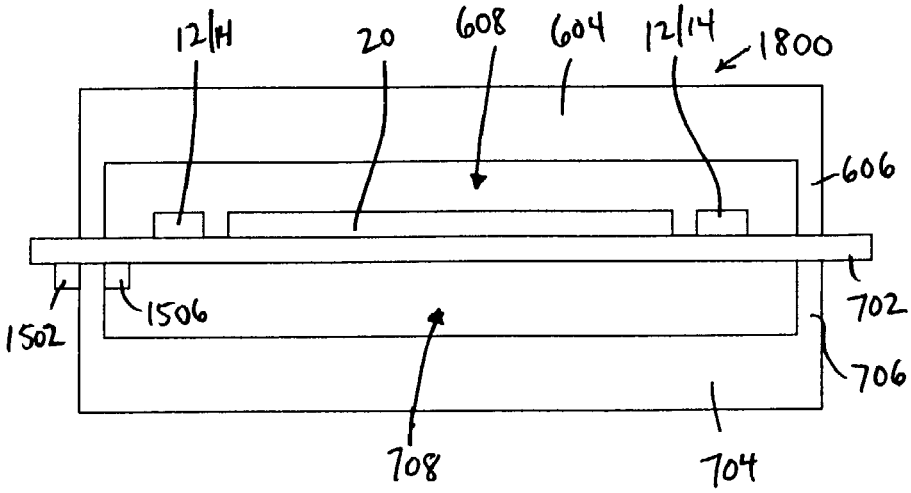
FIG. 18 is a side cutaway schematic diagram of another embodiment of the device of FIG. 17.

In another variation illustrated in the view of FIG. 18, the RF receiver 1506 is mounted or formed on a back surface of substrate 702 near vacuum border, while the RF transmitter 1502 is mounted or formed on the back surface of a portion of the substrate 702 extending outside of the vacuum envelope formed by the back plate structure, 704, the frontplate structure 604 and the substrate 702. Again, the RF transmitter and the RF receiver 1506 are located in close proximity to minimize power requirements and interference.

It is noted that in the variations illustrated in FIGS. 16–18, the TX antenna 1504 and the RX antenna 1508 are not illustrated, although it is understood that they may incorporated within the transmitter/receiver or coupled to the transmitter/receiver. Furthermore, as described above, the vacuum envelope may be specifically designed such that the structure of the vacuum envelope has a thickness sufficient to withstand atmospheric pressure due to the internal vacuum without the use of spacers or walls to maintain uniform separation throughout the display. For example, the thickness of the faceplate structure 604 and substrate 602 are designed to withstand atmospheric pressure without spacers. Additionally, the thickness of the faceplate structure 604 and the backplate structure 704 are designed to withstand atmospheric pressure without spacers. Such "spacer-less" displays are further described in U.S. patent application Ser. No. 10/306,172, filed Nov. 27, 2003, by Russ, et al., entitled "SPACER-LESS FIELD EMISSION DISPLAY", previously incorporated herein by reference. Furthermore, one of ordinary skill in the art may make many modifications to the exact implementation and location of the components consistent with the teachings of these embodiments of the invention.

It is also noted that in an alternative embodiment, much of the control circuitry illustrated in the system of FIG. 14 could be implemented on the back surface of the substrate 702, such as illustrated in the embodiment of FIG. 10. In such embodiment, the input video signal 146 is wirelessly transmitted into the vacuum envelope to the RF receiver 1506. The output of the RF receiver 1506 then coupled to the control circuitry within the vacuum envelope. Thus, one or more of the following control circuits are located (mounted or formed) on the back surface of the substrate 702: the A/D converter 132, the signal processor 134, the frame memory 136, the CPU 138, the memory 140 and the timing control 142. These control circuits may be mounted on the back surface or formed on the back surface (e.g., if an amorphous silicon (a-Si layer is formed, then laser annealed to a p-Si or x-Si layer). Thus, rather than implementing the control circuitry outside of the vacuum envelope, the control circuitry is mounted or formed on the back surface of the substrate 702 and is sealed within the vacuum envelope. In such embodiment, the output of the signal processor 134 and the timing control circuit 142 are coupled to the driver ICs 12, 14 via wireline connections (e.g., printed metal lines).

Figure 19:
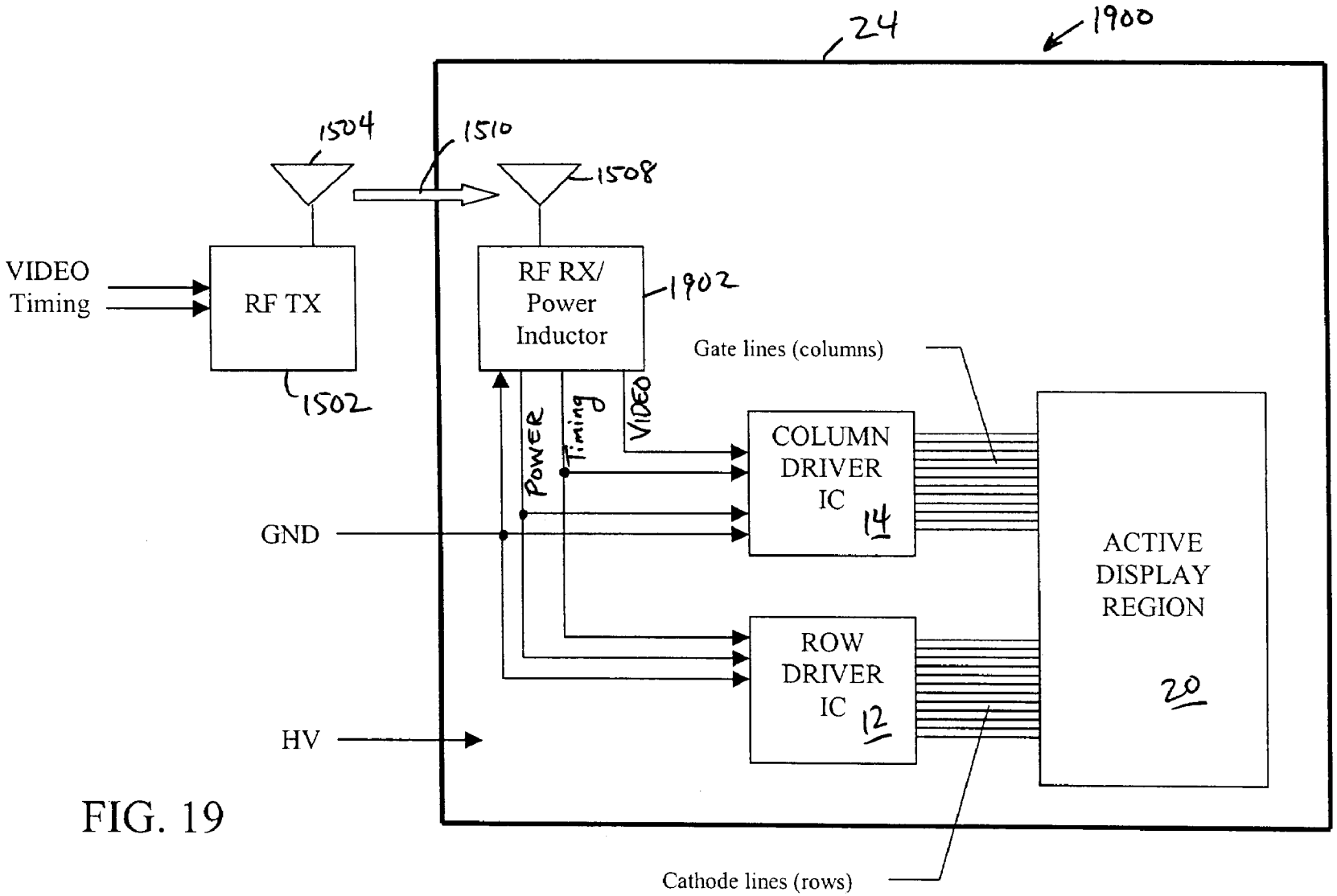
FIG. 19 is a functional block diagram of a variation of the vacuum-sealed device of FIG. 15 which further reduces the number of wire leads that must pass through a vacuum seal by incorporating a power inductor in a wireless receiver to derive a power signal to operate the driver circuitry in accordance with a further embodiment of the invention.

Referring next to FIG. 19, a functional block diagram is shown of a variation of the vacuum-sealed device of FIG. 15 which further reduces the number of wire leads that must pass through a vacuum seal by incorporating a power inductor in the wireless RF receiver to derive a power signal to operate the driver circuitry in accordance with a further embodiment of the invention. In this embodiment of the display device 1900, the RF receiver/power inductor unit 1902 includes a power inductor which generates a power signal through inductive coupling of the received RF signal 1510, as is known in the art. For example, the power inductor converts part of the RF signal 1510 into low voltage power, e.g., $V_{DD}$. As is known, the power is converted from the electromagnetic energy of the RF signal carrier frequency.

In this embodiment, a separate low voltage power signal passing through the vacuum border 24 via a wireline connection is not needed, since all power to operate the driver ICs 12, 14 and the RF receiver/power inductor unit 1902 is provided by the inductively coupled power signal. It is noted that the high voltage (HV) for the anode of the display device 1900 is still needed to pass through the vacuum border 24 via wireline. Thus, according to this embodiment, the required wireline connections passing through the vacuum border 24 include the high voltage (HV) and the ground (GND) signals. The VIDEO, low voltage power ($V_{DD}$) and timing signaling (e.g., CLK, Din, LOAD), are wirelessly received into the vacuum envelope. The power $V_{DD}$ and timing signals are coupled to the driver ICs 12, 14, while input video signal is coupled to the column driver IC 14. The location of the transmitting and receiving devices may be variously located, such as described with reference to FIGS. 15–18.

Figure 20:
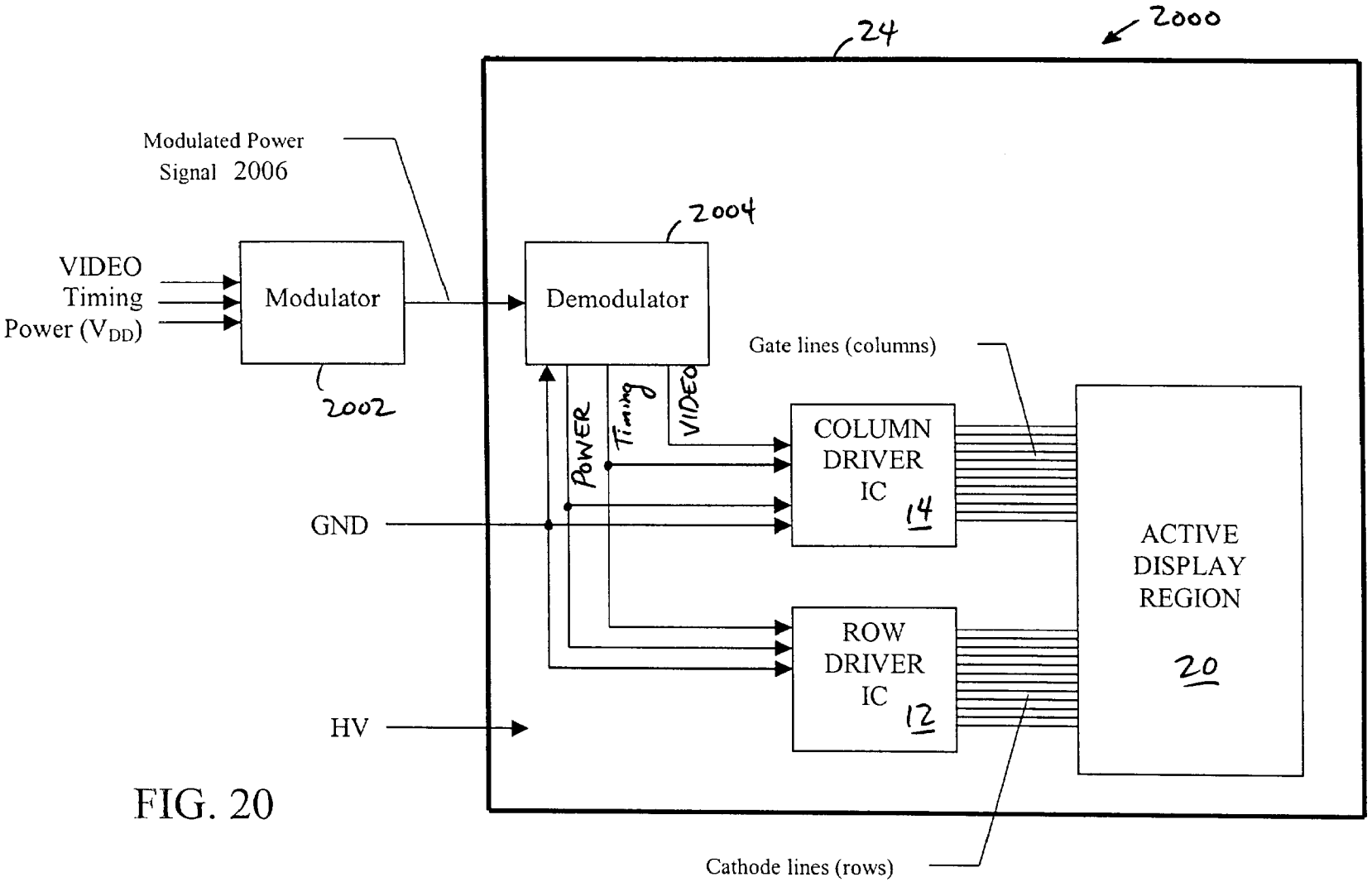
FIG. 20 is a functional block diagram of a display device including driver circuitry on the same substrate as the active display region and is within the vacuum, which further reduces the number of wire leads that must pass through a vacuum seal by modulating the input video signal and timing signals on top of the power signal wire in accordance with yet another embodiment of the invention.

Referring next to FIG. 20, a functional block diagram is shown of a display device 2000 including driver circuitry on the same substrate as the active display region 20 and is within the vacuum, which further reduces the number of wire leads that must pass through a vacuum seal by modulating the input video signal and timing signals on top of the power signal wire in accordance with yet another embodiment of the invention. Similar to the embodiment of FIG. 15, the following wireline connections pass through the vacuum border 24: high voltage (HV) power, ground (GND) and low voltage ($V_{DD}$) power. However, in this embodiment, the input video signal (VIDEO) and timing signaling are "piggy-backed" on top of the low voltage power signal $V_{DD}$. For example, the power signal $V_{DD}$, input video signal and timing signals are coupled to a modulator 2002 located outside of the vacuum border. The modulator 2002 modulates the input video signal and timing signals on the generally constant low voltage power signal. The modulated power signal 2006 is then passed via a wireline connection through the vacuum border to a demodulator 2004. The demodulator 2004 demodulates the input video signal and timing signals from the power signal in order to produce the VIDEO, $V_{DD}$ and timing signals. The power signal $V_{DD}$ and the timing signaling are coupled to the driver ICs 12, 14, while the input video signal (VIDEO) is coupled to the column driver IC 14. Advantageously, separate wireline connections for the input video signal and timing signals passing through the vacuum border 24 are not required. Thus, the number of wireline connections passing through the vacuum border (e.g., into the vacuum envelope) is reduced.

The modulator 2002 and the demodulator 2004 may be variously located. For example, in one embodiment, the modulator 2002 is mounted or formed on a portion of the substrate extending outside of the vacuum envelope. In another embodiment, the modulator is mounted or formed on a separate substrate coupled via wireline connection to the substrate of the display device. Likewise, the demodulator 2004 is mounted or formed on the substrate including the driver ICs 12, 14 and the active display region 20. In one embodiment, the demodulator 2004 is formed on the same surface as the driver ICs and the active display region, which in another embodiment, it is formed on a back surface of the substrate.

It is noted that many of the components described with reference to FIGS. 14–20 are the same or similar to those described with reference to FIGS. 3–13. It is also noted that although the row driver IC 12 and the column driver IC 14 are each illustrated as a single functional block, it is understood that each driver may comprise a cascade of smaller individual driver ICs, each having outputs coupled to a respective portion of the active display region 20. Furthermore, while in preferred embodiments, the vacuum-sealed display device is a field emission display, it is understood that the device may comprise other vacuum-sealed devices, such as plasma displays.

It is noted that the manufacture of such display devices as described in FIGS. 14–20 is similar to the processes described above with the additional steps of forming or mounting the additional components (e.g., wireless components, modulators, demodulators, etc.). It should be noted that the process temperature should take into account the temperature sensitivity of such additional components when vacuum sealing the display devices. For example, the vacuum sealing process should be limited to less than 300 degrees Celsius.

Figure 21:
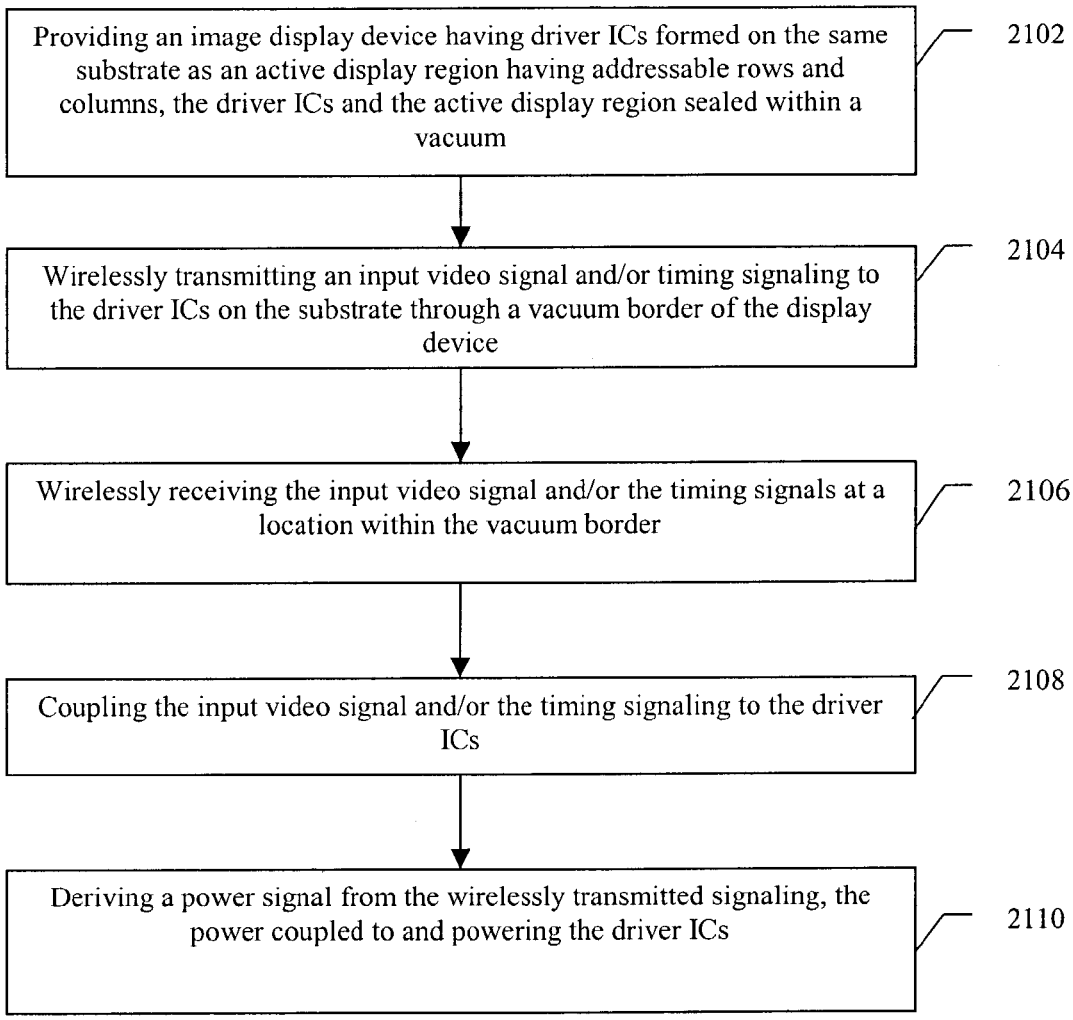
FIG. 21 is a flowchart illustrating the steps performed in accordance with one embodiment of the invention.

Referring next to FIG. 21, a flowchart is shown illustrating the steps performed in accordance with one embodiment of the invention. Initially, an image display device is provided that includes driver ICs formed on the same substrate as an active display region (Step 2102). The active display region includes addressable rows and columns, the driver ICs and the active display region sealed within a vacuum envelope. For example, image display device, such as illustrated in FIGS. 14–19 may be provided. Next, an input video signal and/or timing signaling are wirelessly transmitted (e.g., RF or optical) to the driver ICs on the substrate through a vacuum border of the display device (Step 2104). The vacuum border is defined by a vacuum envelope sealing the portion of the substrate having the driver ICs and the active display region therein. Depending on the embodiment, the input video signal and/or timing signaling is wirelessly transmitted using a radio frequency transmitter/receiver pair or an optical transmitter/receiver pair as known in the art.

Within the vacuum envelope, the input video signal and/or the timing signals are wirelessly received at a location within the vacuum border (Step 2106). Advantageously, a separate wireline connection passing into the vacuum envelope carrying these signals is not required. Next, the input video signal and/or the timing signaling are coupled to the driver ICs (Step 2108). For example, the input video signal is coupled to a column driver IC, while the timing signals are coupled to the column driver IC and a row driver IC. The timing signals may include one or more of a clock (CLK), a latch enable signal (LOAD) and a line reset (Din) signal. In an optional embodiment, a wirelessly transmitted RF signal is converted to a power signal and coupled to the driver ICs (Step 2110). For example, as described in FIG. 19, a power inductor is incorporated into an RF receiver 1902 in order to derive a power signal by inductive power coupling of the received RF signal.

Figure 22:
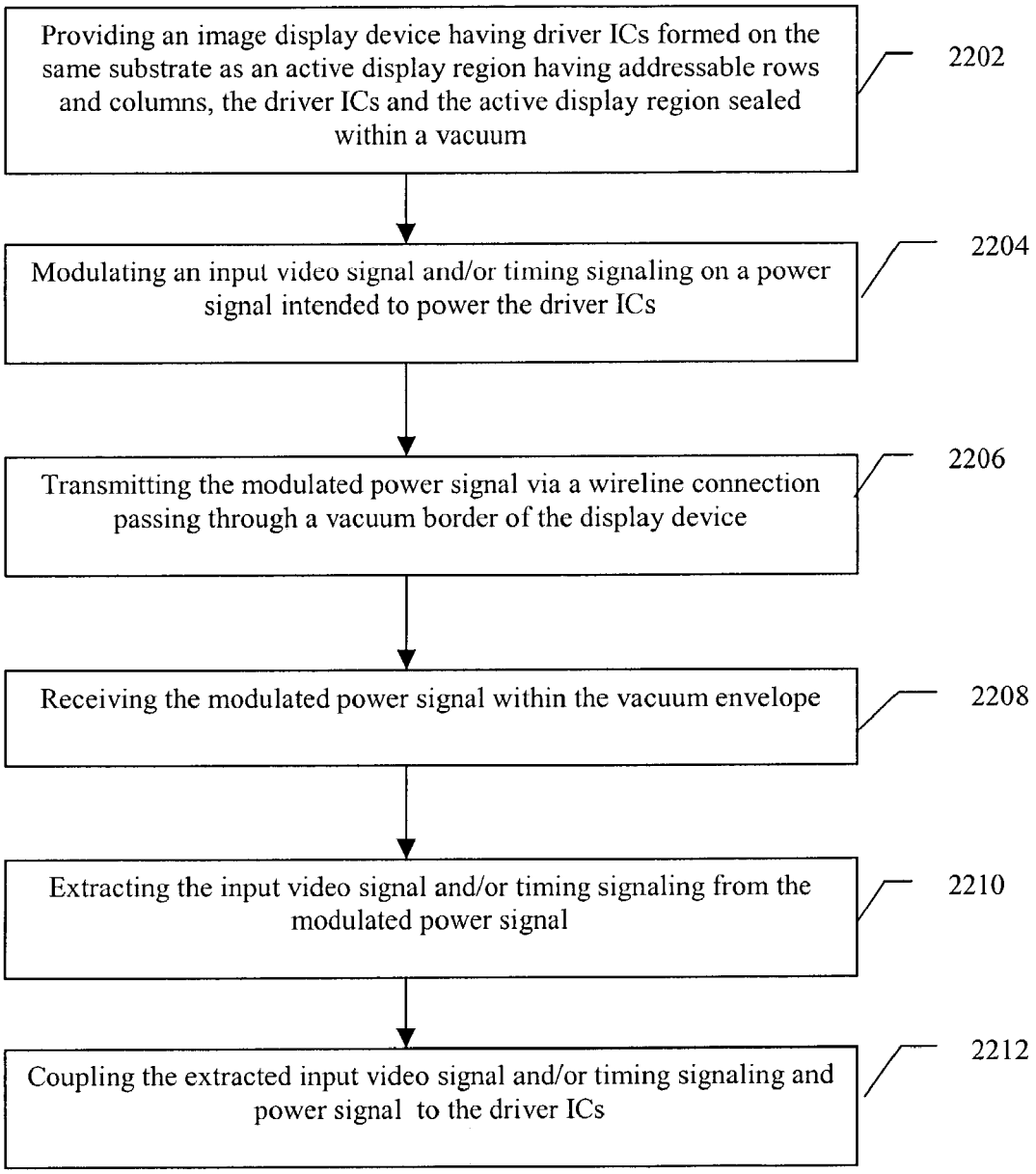
FIG. 22 is a flowchart illustrating the steps performed in accordance with another embodiment of the invention.

Referring next to FIG. 22, a flowchart is shown illustrating the steps performed in accordance with another embodiment of the invention. Initially, an image display device is provided that includes driver ICs formed on the same substrate as an active display region (Step 2202). The active display region includes addressable rows and columns, the driver ICs and the active display region sealed within a vacuum envelope. For example, image display device, such as illustrated in FIG. 20 may be provided. Next, an input video signal and/or timing signaling are modulated onto a power signal (e.g., a low voltage signal) intended to power the driver ICs (Step 2204). For example, the modulator 2002 of FIG. 20 performs this step. Next, the modulated power signal is transmitted via a wireline connection passing through a vacuum border of the display device (Step 2206). The vacuum border is defined by a vacuum envelope sealing the portion of the substrate having the driver ICs and the active display region therein. The modulated power signal is then received within the vacuum envelope (Step 2208), for example, at the demodulator 2004.

Next, the input video signal and/or timing signaling is extracted or demodulated from the modulated power signal (Step 2210). This step is performed for example, by the demodulator 2004 of FIG. 20. Then, the extracted input video signal and/or timing signaling and the power signal are coupled to the driver ICs (Step 2212). For example, the power signal, $V_{DD}$ powers the driver ICs. The input video signal is coupled to the column driver IC, while the timing signaling is coupled to the column and row driver ICs. Again, as described above, this method avoids separate wireline connections passing through the vacuum envelope for the input video and timing signals. It is noted that the devices described herein may be used to perform the methods of FIGS. 21 and 22, as well as other devices not specifically described.

Figure 23:
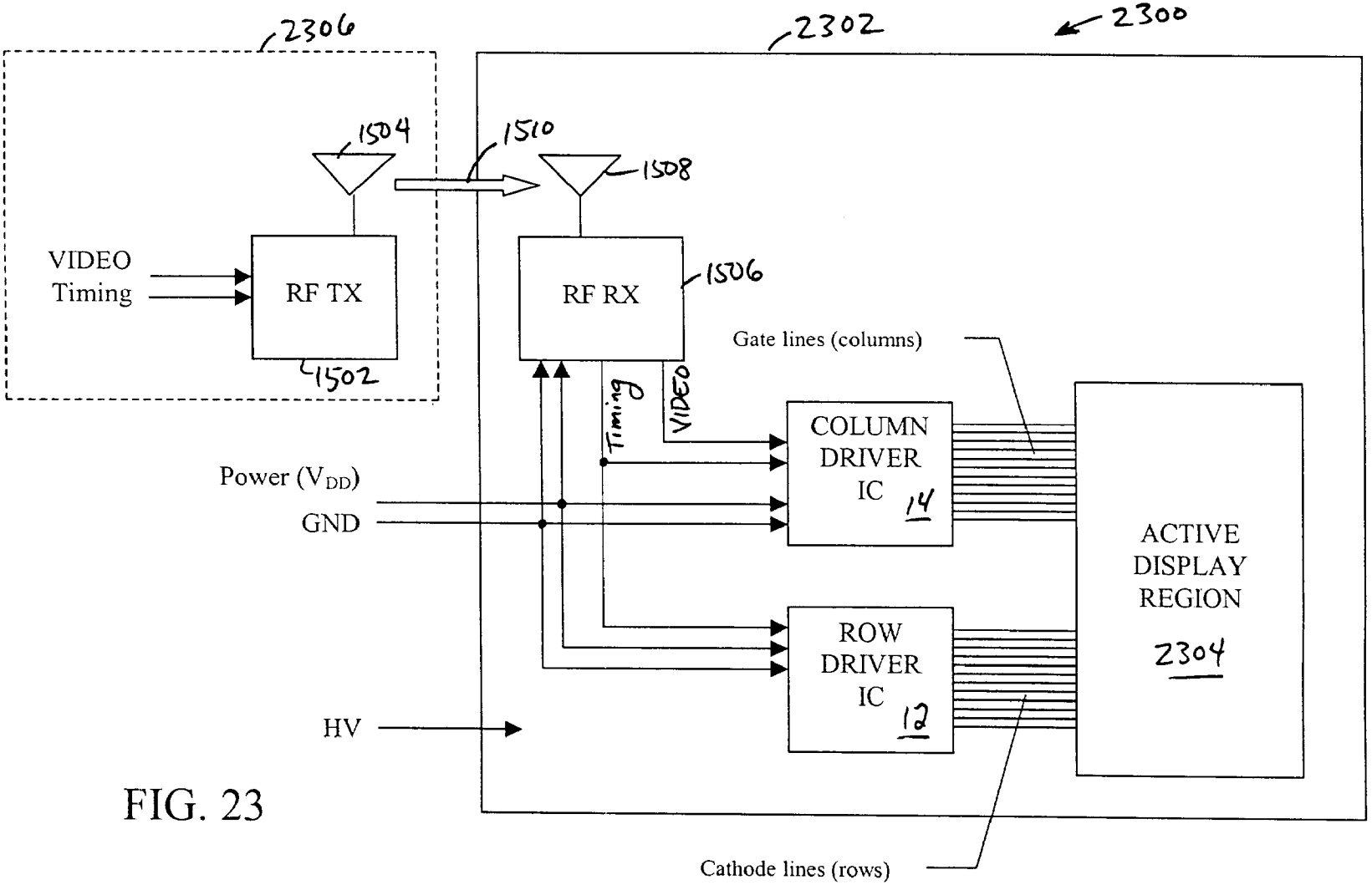
FIG. 23 is a functional block diagram of variation FIG. 15 for a display device not requiring that the active display region be vacuum-sealed and which includes driver circuitry on the same substrate as the active display region, which further reduces the number wireline connections to the substrate by wirelessly transmitting video and timing signals to the driver circuitry in accordance with another embodiment of the invention.

Referring next to FIG. 23, a functional block diagram is shown of variation FIG. 15 for a display device not requiring that the active display region be vacuum-sealed and which includes driver circuitry on the same substrate as the active display region, which further reduces the number wireline connections to the substrate by wirelessly transmitting video and timing signals to the driver circuitry in accordance with another embodiment of the invention. For example, the display device 2300 is a liquid crystal display (LCD) or an electroluminescent (EL) display. This embodiment is similar to that illustrated in FIG. 15; however, there is no vacuum border.

As is known in active matrix LCDs, the active display region 2304 comprises a grid of thin film transistors (TFTs) at the corner of each pixel. For example, as is known, the active display region 2304 includes a TFT layer, liquid crystal layer, top layer and polarizer layers, etc. Thus, as is well known, the matrix of TFTs includes addressable rows and addressable columns. In this embodiment, the row driver IC 12, column driver IC 14 and the active display region 20 of the display device 2300 are all located on the same substrate 2302. However, in order to reduce the number of wireline connections to the substrate 2302, the input video signal (VIDEO) and the timing signals (e.g., Din, CLK and LOAD) are wirelessly transmitted to the substrate 2302. As such, an RF receiver 1506 and RX antenna 1508 are mounted or formed on the substrate 2302 as described above. A corresponding RF transmitter 1502 and TX antenna 1504 are located off of the substrate 2302, e.g., on substrate 2306. Similar to the embodiment of FIG. 15, the video and timing signals are wirelessly transmitted, e.g., as a wireless signal 1510. It is also noted that alternatively, the transmitter and receiver may be optical devices, rather than RF devices.

Advantageously, in this embodiment, separate wireline connections to the substrate 2302 for the input video signal and the timing signals are not required; thus, reducing the number of wireline connections to the substrate 2302. As illustrated, the display device 2300 still requires inputs HV, $V_{DD}$ and GND, each of which is provided via flexible print connectors to printed metal lines (at a substrate input location).

Figure 24:
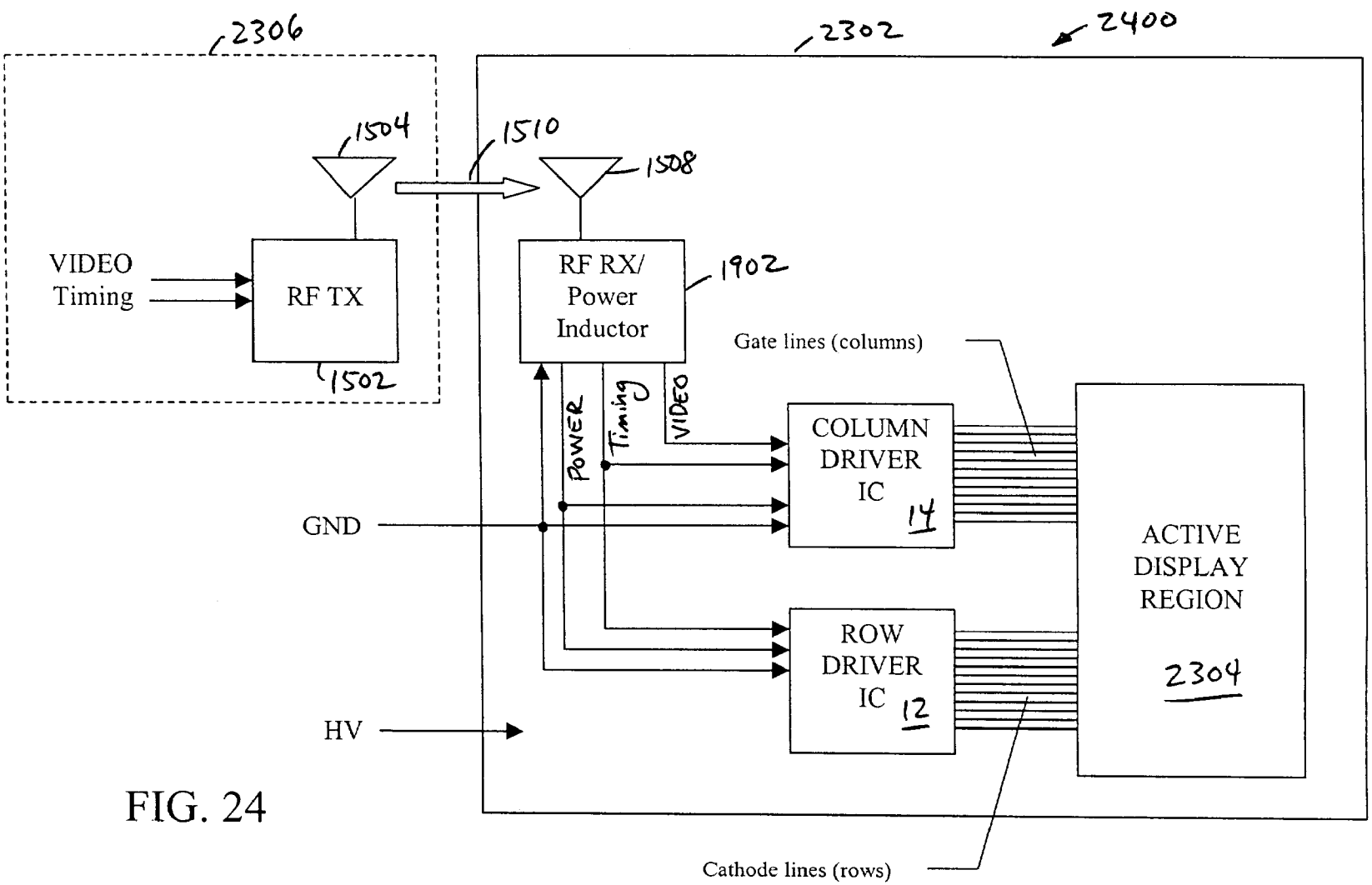
FIG. 24 is a functional block diagram of a variation of the device of FIG. 23, which further reduces the number of wireline connections to the substrate by incorporating a power inductor in a wireless receiver to derive a power signal to operate the driver circuitry in accordance with a further embodiment of the invention.

Referring next to FIG. 24, a functional block diagram is shown of a variation of the device of FIG. 23, which further reduces the number of wireline connections to the substrate 2302 by incorporating a power inductor in a wireless receiver to derive a power signal to operate the driver circuitry in accordance with a further embodiment of the invention. Similar to the embodiment of FIG. 19, in order to further reduce wireline connections to the substrate 2302 of the device 2400, the RF receiver includes a power inductor (i.e., RF receiver/power inductor unit 1902). The unit 1902 converts the received RF signal 1510 into a low voltage power signal ($V_{DD}$), which is coupled to the driver ICs 12, 14. Thus, advantageously as illustrated, the only required wireline connections to the substrate 2302 are the high voltage (HV) and the ground (GND).

Figure 25:
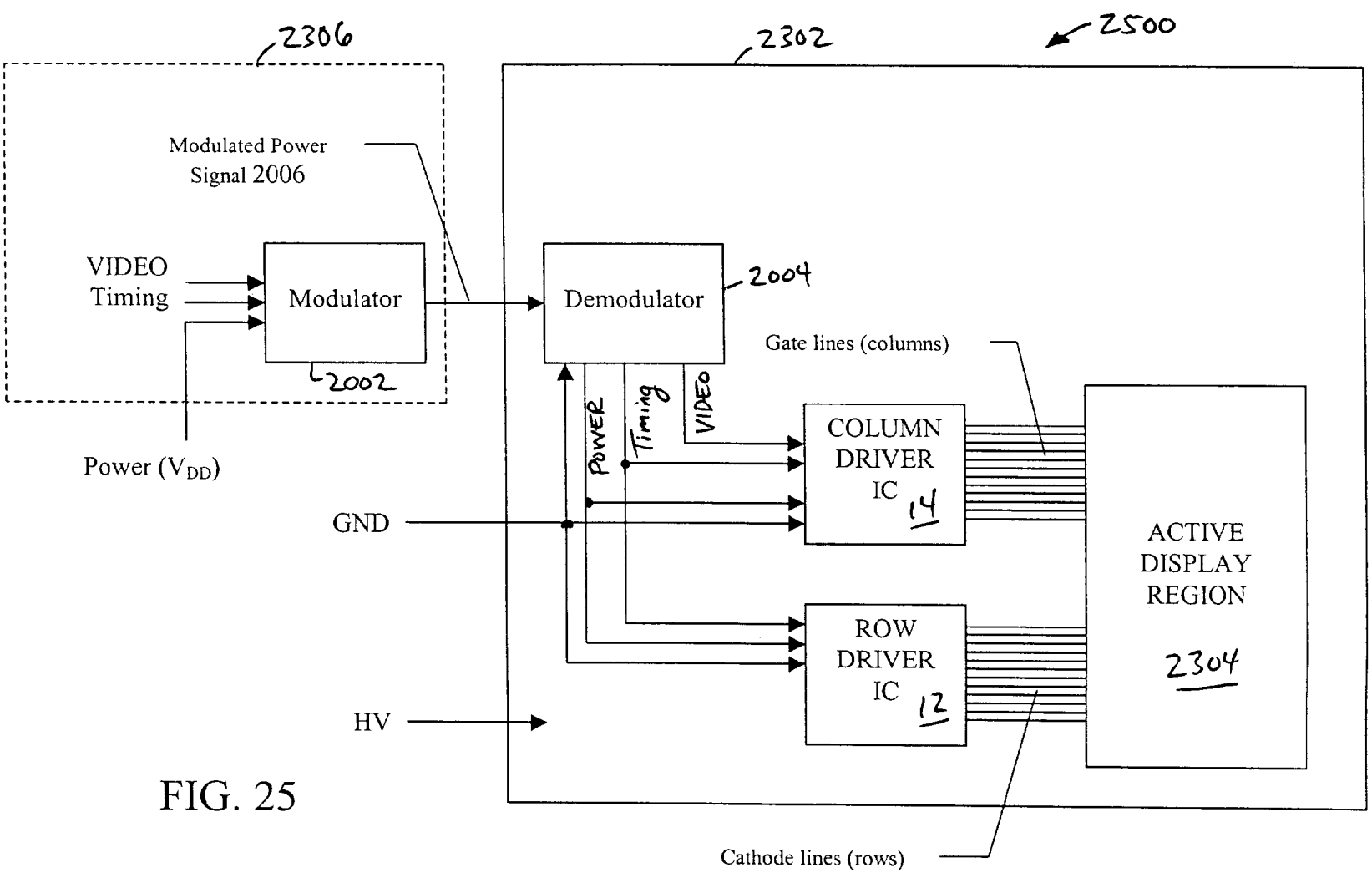
FIG. 25 is a functional block diagram of a variation of the display device of FIG. 20 which does not require that the active display region be vacuum sealed and including driver circuitry on the same substrate as the active display region, which further reduces the number of wireline connections to the substrate by modulating the input video signal and timing signals on top of the power signal wireline connection in accordance with yet another embodiment of the invention.

Referring next to FIG. 25, a functional block diagram is shown of a variation of the display device of FIG. 20 which does not require that the active display region be vacuum sealed and including driver circuitry on the same substrate as the active display region, which further reduces the number of wireline connections to the substrate by modulating the input video signal and timing signals on top of the power signal wireline connection in accordance with yet another embodiment of the invention. Similar to the embodiment of FIG. 20, the device 2500 of FIG. 25 receives a modulated power signal 2006 via a single wireline connection to the substrate 2302. The modulated power signal 2006 has been modulated to carry the input video signal and the timing signals, e.g., by modulator 2002 on a separate substrate 2306. A demodulator 2004 mounted or formed on the substrate 2302 then demodulates the signal to provide the low voltage power signal ($V_{DD}$), the input video signal and the timing signaling to the driver ICs 12, 14. Again, this reduces the number of wireline connections to the substrate 2302.

It should be understood that while an LCD is specifically described in the embodiments of FIGS. 23–25, these techniques also apply to any row/column addressable display device which does not require that the active display region be sealed within a vacuum, such as an electroluminescent (EL) display. It is further noted that the methods described with reference to FIGS. 21 and 22 may be slightly modified to specifically cover display devices not requiring a vacuum. For example, the same basic steps are followed; however, instead of transmitting signaling through the vacuum envelope or vacuum border, the signaling is transmitted to the substrate including the driver ICs and the active display region.

It is noted that the manufacture of such display devices as described in FIGS. 23–25 is similar to the processes described above with the additional steps of forming or mounting the additional components (e.g., wireless components, modulators, demodulators, etc.). Again such additional components may be formed or mounted on the substrate 2302 as is known in the art. The additional components are preferably coupled to the driver ICs via printed metal lines formed using photolithography to create solid state connections to devices on the same substrate.

The foregoing presentation of the described embodiments is provided to enable any person skilled in the art to make or use the invention as claimed. While the invention herein disclosed has been described by means of specific embodiments and applications thereof, numerous modifications and variations could be made thereto by those skilled in the art without departing from the scope of the invention set forth in the claims.

What is claimed is:

1. An image display device comprising:

a substrate;

an active display region formed on the substrate, the active display region including a plurality of addressable rows and a plurality of addressable columns defining pixels;

one or more driver ICs on the substrate, respective outputs of each driver IC coupled to respective ones of the plurality of addressable rows and the plurality of addressable columns, the one or more driver ICs adapted to drive the active display region to display an image;

a wireless receiver coupled to the one or more driver ICs, the wireless receiver adapted to wirelessly receive a wireless signal including an input video signal for display and couple the input video signal to the one or more driver ICs;

a wireless transmitter adapted to wirelessly transmit the wireless signal to the wireless receiver; and a vacuum envelope forming a sealed volume containing at least a portion of the substrate, the one or more driver ICs, the active display region and the wireless receiver, the sealed volume maintained in a vacuum.

2. The device of claim 1 wherein the image display device comprises a plasma display.

3. The device of claim 1 wherein the wireless receiver is located on an interior surface of the vacuum envelope.

4. The device of claim 1 wherein wireless receiver is located on the substrate.

5. The device of claim 1 wherein the image display device comprises a field emission display.

6. The device of claim 1 wherein the wireless receiver comprises a wireless radio frequency receiver, the wireless signal received as a wireless radio frequency signal.

7. The device of claim 1 wherein the wireless receiver comprises a wireless optical receiver, the wireless signal received as a wireless optical signal.

8. The device of claim 1 wherein the wireless signal further includes timing signals which are coupled to the one or more driver ICs.

9. The device of claim 1 wherein the one or more driver ICs comprise:

one or more row driver ICs; and one or more column driver ICs, the input video signal coupled to the one or more column driver ICs.

10. The device of claim 1 wherein the vacuum envelope comprises a faceplate structure.

11. The device of claim 10 wherein the vacuum envelope further comprises a backplate structure, the substrate held in between the faceplate structure and the backplate structure.

12. The device of claim 1 wherein the wireless receiver is located on the substrate.

13. The device of claim 12 wherein the image display device comprises a device selected from a group consisting of a liquid crystal display and an electroluminescent display.

14. An image display device comprising:

a substrate;

an active display region formed on the substrate, the active display region including a plurality of addressable rows and a plurality of addressable columns defining pixels;

one or more driver ICs on the substrate, respective outputs of each driver IC coupled to respective ones of the plurality of addressable rows and the plurality of addressable columns, the one or more driver ICs adapted to drive the active display region to display an image; and a wireless receiver coupled to the one or more driver ICs, the wireless receiver adapted to wirelessly receive a wireless signal including an input video signal for display and couple the input video signal to the one or more driver ICs;

wherein the wireless receiver comprises a wireless radio frequency receiver and includes a power inductor, the power inductor adapted to generate a power signal from a received wireless radio frequency signal, the power signal coupled to the one or more driver ICs, whereby a separate wireline input power signal is not required to be coupled to the one or more driver ICs.

15. The device of claim 14 wherein the wireless receiver comprises a wireless radio frequency receiver, the wireless signal received as a wireless radio frequency signal.

16. The device of claim 14 wherein the wireless signal further includes timing signals which are coupled to the one or more driver ICs.

17. The device of claim 14 wherein the one or more driver ICs comprise:

one or more row driver ICs; and one or more column driver ICs, the input video signal coupled to the one or more column driver ICs.

18. The device of claim 14 wherein the wireless receiver is located on the substrate.

19. The device of claim 18 wherein the image display device comprises a device selected from a group consisting of a liquid crystal display and an electroluminescent display.

20. The device of claim 14 further comprising a vacuum envelope forming a sealed volume containing at least a portion of the substrate, the one or more driver ICs, the active display region and the wireless receiver, the sealed volume maintained in a vacuum.

21. The device of claim 20 wherein the wireless receiver is located on an interior surface of the vacuum envelope.

22. The device of claim 20 wherein wireless receiver is located on the substrate.

23. The device of claim 20 wherein the image display device comprises a field emission display.

24. The device of claim 20 wherein the image display device comprises a plasma display.

25. The device of claim 20 wherein the vacuum envelope comprises a faceplate structure.

26. The device of claim 25 wherein the vacuum envelope further comprises a backplate structure, the substrate held in between the faceplate structure and the backplate structure.

27. A method for use in an image display device comprising:

wirelessly receiving a signal inside a vacuum envelope of the image display device, the vacuum envelope sealing an active display region and one or more driver ICs on a substrate in a vacuum, the active display region including a plurality of addressable rows and a plurality of addressable columns defining pixels, wherein the signal comprises an input video signal;

coupling the input video signal to the one or more driver ICs, the one or more driver ICs adapted to drive the active display region to display an image; and wirelessly transmitting the signal from outside of the vacuum envelope through a portion of the vacuum envelope.

28. The method of claim 27 wherein the receiving step comprises wirelessly receiving a radio frequency signal inside the envelope.

29. The method of claim 27 wherein the receiving step comprises wirelessly receiving the signal, the signal further comprising one or more timing signals;

the method further comprising coupling the one or more timing signals to the one or more driver ICs.

30. A method for use in an image display device comprising:

wirelessly receiving a signal inside a vacuum envelope of the image display device, the vacuum envelope sealing an active display region and one or more driver ICs on a substrate in a vacuum, the active display region including a plurality of addressable rows and a plurality of addressable columns defining pixels;

wherein the signal comprises an input video signal;

wherein the receiving step comprises wirelessly receiving a radio frequency signal inside the envelope;

coupling the input video signal to the one or more driver ICs, the one or more driver ICs adapted to drive the active display region to display an image;

deriving a power signal from the radio frequency signal having been received using power inductive coupling; and coupling the power signal to the one or more driver ICs.

31. The method of claim 30 wherein the receiving step comprises wirelessly receiving the signal, the signal further comprising one or more timing signals;

the method further comprising coupling the one or more timing signals to the one or more driver ICs.

* * * * *